US005897031A

United States Patent [19]

Wirt et al.

[11] Patent Number: 5,897,031

[45] Date of Patent: Apr. 27, 1999

[54] DISPENSER FOR ANTIMICROBIAL LIQUIDS

[75] Inventors: David F. Wirt, Prescott; Floyd L. Foslien, Troy Township, both of Wis.

[73] Assignee: Minnesota Mining and Manufacturing Company, St. Paul, Minn.

[21] Appl. No.: 08/668,198

[22] Filed: Jun. 21, 1996

[51] Int. Cl.[6] ..... B65D 37/00

[52] U.S. Cl. ..... 222/179; 222/181.3; 222/375; 222/380; 222/383.1

[58] Field of Search ..... 222/179, 181.2, 222/181.3, 341, 372, 375, 380, 383.1, 571

[56] References Cited

U.S. PATENT DOCUMENTS

| | | | |
|---|---|---|---|
| D. 304,548 | 11/1989 | Freitas | D9/373 |
| 1,174,674 | 3/1916 | Byer . | |
| 1,219,364 | 3/1917 | Wise . | |
| 1,565,686 | 12/1925 | Titas . | |
| 1,736,392 | 11/1929 | Coss et al. . | |
| 1,949,315 | 2/1934 | Levernier | 221/94 |
| 2,032,163 | 2/1936 | Bagby | 222/372 |
| 2,283,529 | 5/1942 | Bobrick | 221/102 |
| 2,294,236 | 8/1942 | Levernier | 222/179 |
| 2,456,958 | 12/1948 | Kretschmer et al. | 222/179 |
| 2,488,266 | 11/1949 | Brenn | 222/179 |
| 2,537,415 | 1/1951 | Loeb et al. | 222/340 |
| 2,616,095 | 11/1952 | Stuckey | 4/166 |
| 2,703,191 | 3/1955 | Jernander | 222/341 |
| 2,824,676 | 2/1958 | Still et al. | 222/442 |
| 2,975,942 | 3/1961 | Giordano et al. | 222/380 |
| 2,978,149 | 4/1961 | Rosen | 222/318 |
| 3,072,297 | 1/1963 | Lippman et al. | 222/181 |
| 3,090,528 | 5/1963 | Ellis | 222/179 |
| 3,197,081 | 7/1965 | Midworth | 222/179 |
| 3,203,597 | 8/1965 | Birch | 222/179 |
| 3,231,149 | 1/1966 | Yuza | 222/324 |
| 3,233,787 | 2/1966 | Ross | 222/179 |
| 3,381,856 | 5/1968 | Hrdina | 222/48 |
| 3,465,924 | 9/1969 | Michaels | 222/341 |
| 3,485,419 | 12/1969 | Taylor | 222/380 |
| 3,584,834 | 6/1971 | Reid et al. | 251/321 |
| 3,741,439 | 6/1973 | Vehrs | 222/103 |
| 3,870,201 | 3/1975 | Asplund | 222/207 |
| 3,897,890 | 8/1975 | Jente | 222/179 |
| 3,952,924 | 4/1976 | Benson | 222/181 |
| 3,977,569 | 8/1976 | Scholle | 222/105 |
| 4,130,224 | 12/1978 | Norman et al. | 222/185 |
| 4,222,500 | 9/1980 | Capra et al. | 222/207 |
| 4,340,158 | 7/1982 | Ford et al. | 222/321 |
| 4,371,097 | 2/1983 | O'Neill | 222/321 |
| 4,489,857 | 12/1984 | Batlas | 222/179 |
| 4,493,440 | 1/1985 | Von Buelow et al. | 222/181.2 |
| 4,534,669 | 8/1985 | Heck et al. | 401/134 |
| 4,546,904 | 10/1985 | Frassanito | 222/185 |
| 4,561,571 | 12/1985 | Chen | 222/181.2 |
| 4,564,127 | 1/1986 | Garabedian et al. | 222/96 |
| 4,586,635 | 5/1986 | Collins, Jr. | 222/94 |
| 4,615,476 | 10/1986 | Hobbs et al. | 222/153 |
| 4,645,094 | 2/1987 | Acklin et al. | 222/52 |
| 4,667,854 | 5/1987 | McDermott et al. | 222/101 |
| 4,671,428 | 6/1987 | Spatz | 222/105 |

(List continued on next page.)

FOREIGN PATENT DOCUMENTS

| | | |
|---|---|---|
| 023975 | 2/1981 | European Pat. Off. . |
| 173885 | 3/1986 | European Pat. Off. . |
| 3819412 | 12/1989 | United Kingdom . |

*Primary Examiner*—J. Casimer Jacyna
*Attorney, Agent, or Firm*—Gary L. Griswold; Robert W. Sprague; Jeffrey J. Hohenshell

[57] ABSTRACT

A dispenser for dispensing products such as liquid antimicrobials is described. The dispenser includes a bracket/actuator assembly and a container assembly. The dispenser includes a novel mechanism for attaching the container assembly to the bracket/actuator assembly and also includes a novel valve assembly.

32 Claims, 21 Drawing Sheets

U.S. PATENT DOCUMENTS

| | | | |
|---|---|---|---|
| 4,673,109 | 6/1987 | Cassia | 222/153 |
| 4,705,195 | 11/1987 | Heck | 222/207 |
| 4,792,064 | 12/1988 | Loesel, Jr. et al. | 222/181 |
| 4,793,521 | 12/1988 | Steiner | 222/156 |
| 4,838,460 | 6/1989 | Moore et al. | 222/153 |
| 4,895,276 | 1/1990 | Maldonado | 222/144 |
| 4,921,131 | 5/1990 | Binderbauer et al. | 222/52 |
| 4,930,670 | 6/1990 | Kuo | 222/321 |
| 4,946,072 | 8/1990 | Albert et al. | 222/105 |
| 4,949,877 | 8/1990 | Hanna et al. | 222/341 |
| 4,967,935 | 11/1990 | Celest | 222/63 |
| 5,100,027 | 3/1992 | Gueret | 222/105 |
| 5,156,300 | 10/1992 | Spahni et al. | 222/105 |
| 5,222,633 | 6/1993 | Blake | 222/179 |
| 5,226,625 | 7/1993 | Hanna | 248/222.1 |
| 5,234,132 | 8/1993 | Bachand et al. | 222/182 |
| 5,253,788 | 10/1993 | Vandromme et al. | 222/321 |
| 5,277,332 | 1/1994 | Rogers | 222/181.2 |
| 5,287,996 | 2/1994 | Uhlig | 222/189 |
| 5,301,852 | 4/1994 | Mancini | 222/321 |
| 5,312,018 | 5/1994 | Evezich | 222/95 |
| 5,332,129 | 7/1994 | Brattoli et al. | 222/321 |
| 5,356,038 | 10/1994 | Banks | 222/181.2 |
| 5,379,813 | 1/1995 | Ing | 222/181.2 |
| 5,435,465 | 7/1995 | El-Amin | 222/181.2 |
| 5,439,143 | 8/1995 | Brown et al. | 222/185 |
| 5,622,317 | 4/1997 | Foster | 239/333 |

DISPENSER FOR ANTIMICROBIAL LIQUIDS

TECHNICAL FIELD

The present invention relates generally to product dispensers, and more particularly to liquid or fluid dispensers specially adapted to dispense cleansing, disinfecting or sterilizing products such as antiseptic soaps, hydroalcoholic solutions, disinfecting lotions, cleaning solutions and other antimicrobial liquids.

BACKGROUND

In food processing establishments, surgical centers, physician and dental offices, hospitals and other healthcare facilities, contamination of objects (e.g. hands) with infectious or other deleterious materials is a significant problem. The use of a contaminated object (e.g. a surgeon's hand) in such environments can be a serious problem.

To address the problems associated with the spread of bacteria and microorganisms, the art has developed a variety of dispensers adapted to provide products for cleaning, disinfecting and potentially even sterilizing objects. For example, antiseptic preparation of a surgeon's hands conventionally includes a prolonged hand and lower arm scrubbing with an antimicrobial soap. The antimicrobial soap is typically dispensed from a liquid soap dispenser mounted near a scrub sink. To resist contamination, antimicrobial soap dispensers are designed to be operated without hand contact by mechanical, pneumatic or electromechanical means.

The contamination problem extends not just to the objects to be cleaned but to the external and internal portions of dispensers themselves. Contamination accumulation over time is a problem to be addressed for each object left in a room over time. U.S. Pat. No. 3,203,597 discloses a surgical soap dispenser which includes a complex bracket/actuator assembly and a bottle/pump assembly. The entire fluid (soap) path is provided in the bottle/pump assembly. The bottle/pump assembly is disposable in order to resist contamination build up in the fluid path. However, the bracket/actuator assembly is intended to be reusable and must itself be cleaned and disinfected. The bracket/actuator assembly comprises a complex structure including keyways and cam surfaces. This complex structure may tend to collect debris and make it very difficult to clean.

Set up and maintenance of a dispenser are also affected by the contamination problem. Dispensers which require excessive handling during set up or maintenance increase the risk of contamination by the person preparing or maintaining the dispenser. For example, refillable bottles of soap with a threaded cap structure require personnel to rotate the cap relative to the rest of the dispenser for several revolutions. U.S. Pat. No.'s 4,667,854; 4,921,131; 4,946,070; 4,946,0721 and 5,156,300 disclose various dispensers which appear more difficult to set up and maintain than the present invention. Those patents disclose dispensers which include doors, flaps or covers which are opened and closed. Some of those dispensers include refill elements which are carefully placed in position to avoid dispenser malfunction. In U.S. Pat. No. 3,203,597, the entire refill bottle must be rotated ninety degrees so that a flange on a piston may be received in a slot in an actuator assembly. Dispensers which are complicated to set up or maintain increase the risk of improper set up due to operator error with the attendant risk of unsatisfactory dispenser performance or malfunction.

Problems are also associated with the storage, transportation, handling and shipping of prior art dispensers which include valve and pump means. For example, in U.S. Pat. No. 3,203,597, a pump mechanism projects from the end of a soap container. Care needs to be taken that the pump mechanism is not inadvertently actuated during storage, transportation, handling and shipping of the soap container. The art has developed articles such as caps and removable inserts which are designed to prevent inadvertent actuation of the dispenser prior to use by the intended user. However, these additional articles tend to complicate set up of the dispenser and may also add cost to the dispenser.

SUMMARY OF THE INVENTION

According to the present invention there is provided a container assembly for a product dispenser which (1) affords quick, convenient set up, refill and maintenance without requiring excessive user handling, (2) is easily cleaned, (3) reduces opportunities for contamination build up in its product path, (4) may optionally provide precise, repeatable metered amounts of product, regardless of the volume of product in a reservoir, (5) has a low profile, (6) optionally includes a novel nozzle for reducing dripping, waste, drying and clogging, (7) may be actuated without hand contact to avoid contamination due to actuation, and (8) includes container and bracket/actuator assemblies and an attachment mechanism which automatically aligns elements of the container and bracket/actuator assemblies without the need for excessive handling.

According to the present invention, there is provided a container assembly that is attachable to a bracket/actuator assembly. The bracket/actuator assembly has a movable actuator and a pair of mounting flanges. The actuator is movable between a retracted position which affords attachment of the container assembly to the bracket/actuator assembly and an extended position that is spaced from the retracted position. The container assembly comprises a reservoir for holding product to be dispensed, an outlet sized and shaped to afford passage of product to be dispensed, and a pump that is operatively associated with the actuator. The pump includes a driven surface for receiving the actuator. The driven surface is adapted to be driven by the actuator when the actuator moves from the retracted to the extended position.

The container assembly also includes a pair of channels which are sized and shaped to cooperatively receive the mounting flanges of the bracket/actuator assembly to attach the container assembly to the bracket/actuator assembly and to align the driven surface of the pump with the actuator when the container assembly is attached to the bracket/actuator assembly. The container assembly is attachable to the bracket/actuator assembly in a vertically downward direction. The channels of the bracket/actuator assembly are elongate and situated so that they taper toward each other in the direction of attachment so that the driven surface of the pump is guided into a predetermined orientation relative to the actuator upon attachment of the container assembly to the bracket/actuator assembly.

The container assembly includes a valve assembly having inner surfaces. The inner surfaces receive the pump and define a pump chamber. The valve assembly also has outer surfaces including sealing surfaces for sealing the reservoir, and grasping surfaces that are sized and shaped to be manually grasped. The valve assembly also includes the outlet. Surfaces extend between the inner and outer surfaces to define a fill hole for the pump chamber. The valve assembly is adapted to move between a sealed position with the sealing surfaces sealing the pump chamber from the reservoir, and a dispense position with the fill hole affording passage of the product from the reservoir to the pump chamber.

Alternatively, the present invention may be viewed as a unique method of dispensing product.

BRIEF DESCRIPTION OF THE DRAWING

The present invention will be further described with reference to the accompanying drawing wherein like reference numerals refer to like parts in the several views, and wherein:

FIGS. 26 through 30 are cross-section views of portions of the container assembly which sequentially illustrate the operation of the container assembly, wherein:

FIG. 26 illustrates a piston in a return position and the optional flexible, resilient member in a relaxed position;

FIG. 27 illustrates the position of the piston just after the actuator moves the piston toward an actuated position (with the actuator omitted to emphasize other details) and a displaced sealing position of the flexible, resilient member, with the direction of the piston movement illustrated with an arrow;

FIG. 28 illustrates piston as it moves further toward the actuated position, and the flexible resilient member in a deflected, dispense position which affords dispensing of the product to be dispensed through an outlet in the valve assembly, with the direction of the piston movement illustrated with an arrow;

FIG. 29 illustrates the piston in the actuated position, and the flexible, resilient member returned to the displaced sealing position, with the flow of air into the reservoir illustrated with arrows; and FIG. 30 illustrates the piston on a return stroke from the actuated position toward the return position, the flexible, resilient member returned to the relaxed position, and the ball of a ball valve displaced to afford flow of product from the reservoir into a pump chamber, with the flow of the product from the reservoir into pump chamber illustrated with arrows, and with the direction of the piston movement illustrated with an arrow.

DETAILED DESCRIPTION

Figure 1:
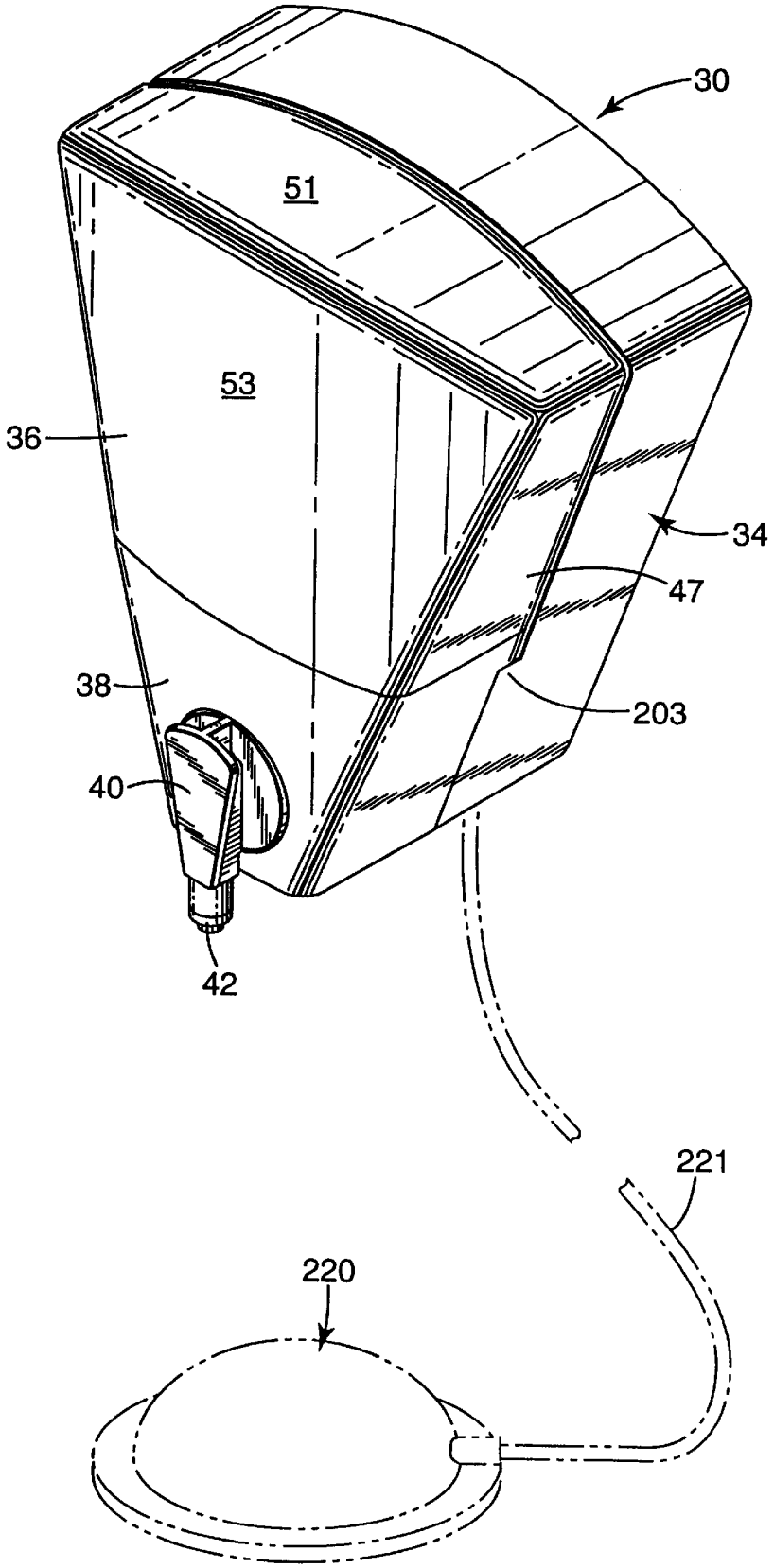
FIG. 1 is a perspective view of a container assembly attached to a bracket/actuator assembly, with a foot actuated pneumatic bladder pump shown in phantom lines.
Figure 25:
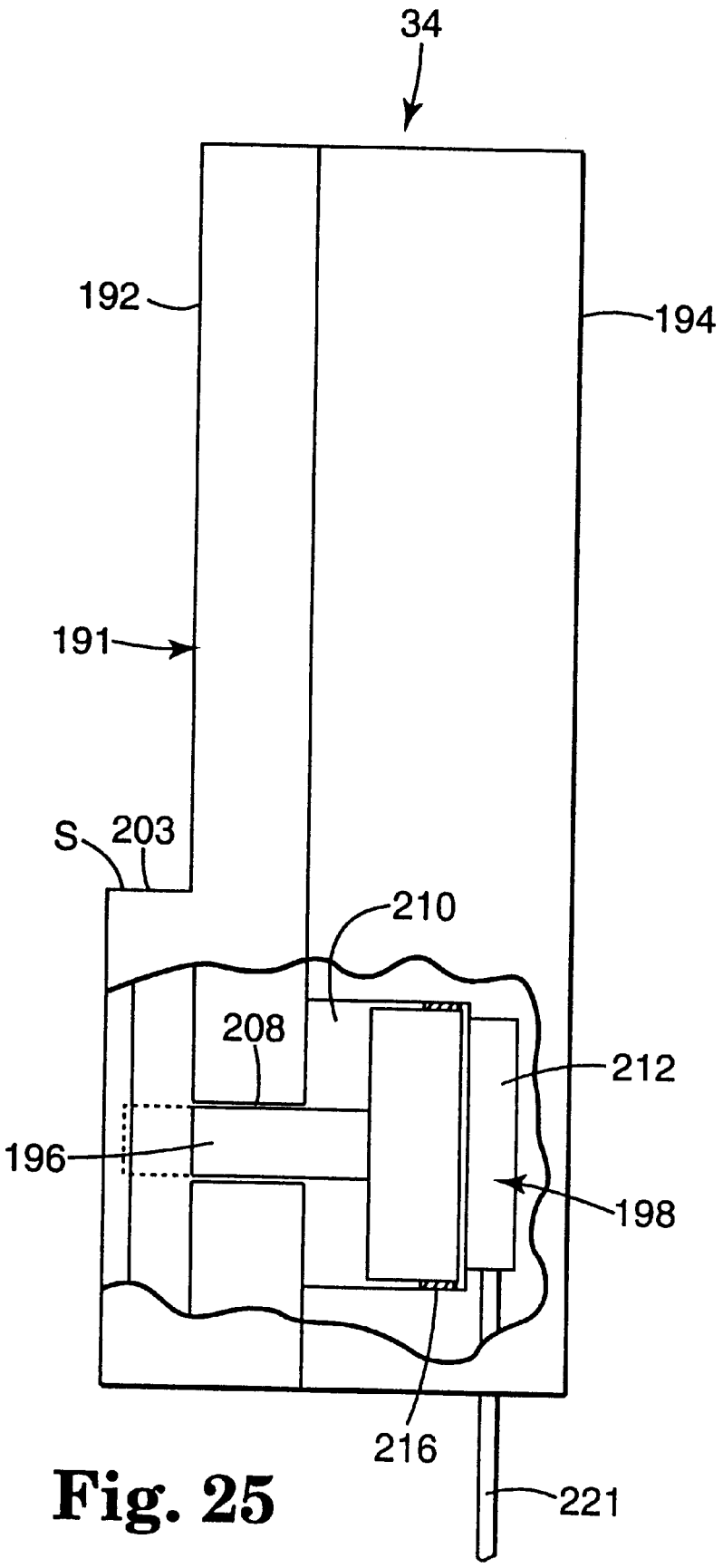
FIG. 25 is a side view of the bracket/actuator assembly of FIG. 24 with portions broken away to schematically illustrate internal elements of the bracket/actuator assembly, and with an actuator shown in a retracted position with solid lines and in an extended position with phantom lines.

Referring to FIG. 1, the present invention is directed to a dispenser 30 (or components thereof) for dispensing product. The dispenser 30 comprises a container assembly 32 (FIG. 3) which is removably attachable to a bracket/actuator assembly 34. The bracket/actuator assembly 34 includes an actuator 196 that is movable between a retracted position (see FIG. 3, FIG. 25, solid lines) which affords attachment of the container assembly 32 to the bracket/actuator assembly 34 and an extended position (FIG. 25, dashed lines). The bracket/actuator assembly 34 also includes a pair of inwardly directed mounting flanges 200 and 202 which will be described in greater detail below.

Figure 11:
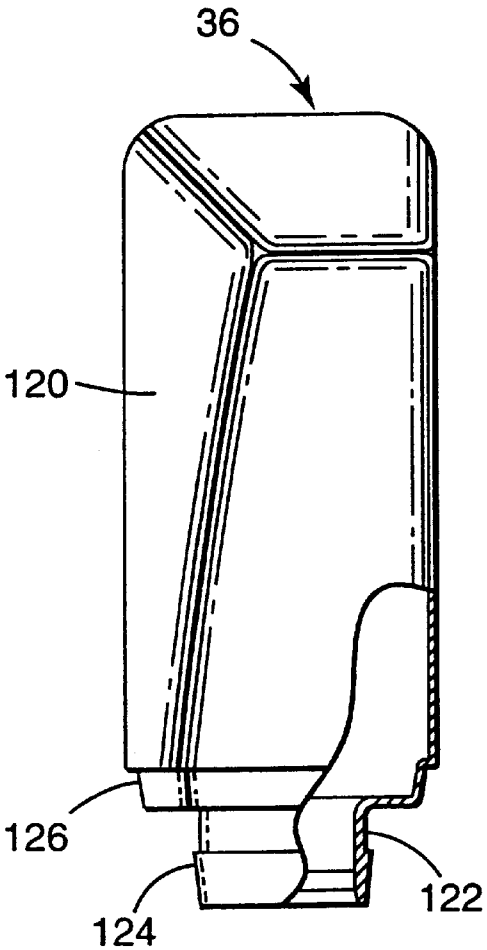
FIG. 11 is a side view of the reservoir of FIG. 10.
Figure 10:
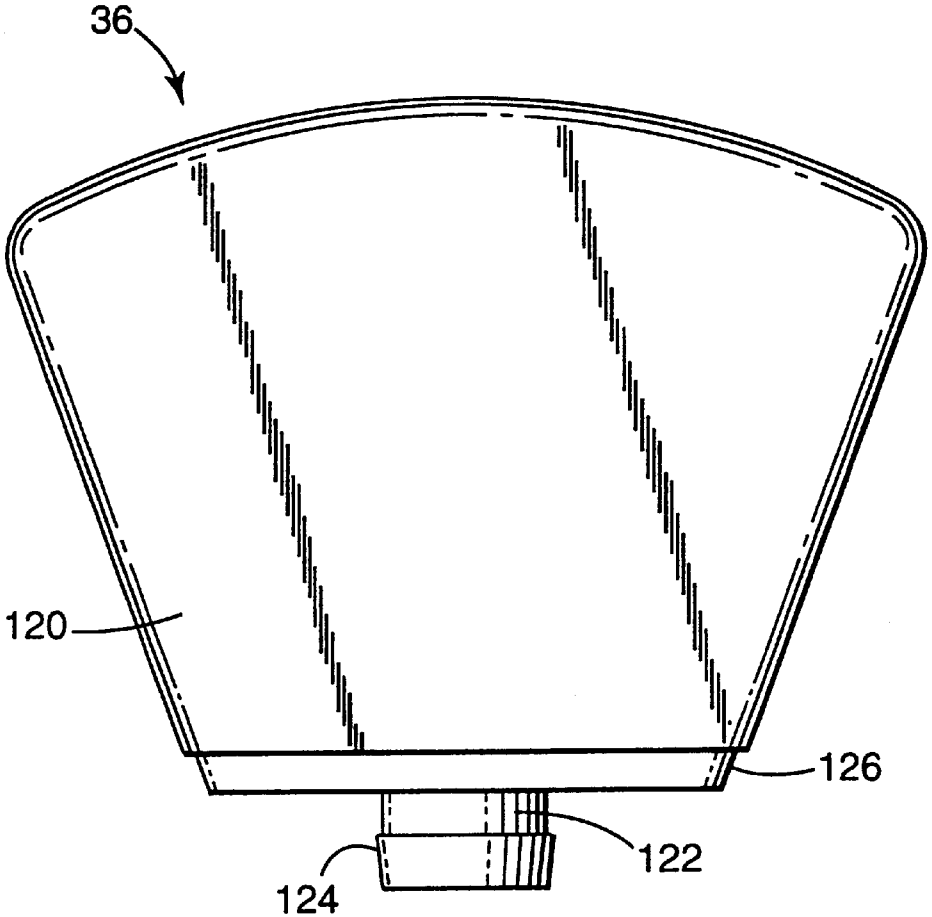
FIG. 10 is a front view of a reservoir for holding product to be dispensed which forms a portion of the container assembly.

The container assembly 32 includes a reservoir for holding product to be dispensed. The dispenser 30 is particularly suitable for dispensing cleansing, disinfecting or sterilizing liquids, fluids, compositions or solutions, such as antiseptic soaps, hydroalcoholic solutions, disinfecting lotions, cleaning solutions and other antimicrobial liquids. For example, the product may comprise the compositions described in U.S. patent application Ser. No.'s 08/493,714 (filed Jun. 22, 1995 entitled, "Stable Hydroalcoholic Compositions") and 08/493,695 (filed Jun. 22, 1995 entitled, "Stable Hydroalcoholic Compositions"), the entire contents of each of which are herein incorporated by reference. While the dispenser 30 is particularly suitable for dispensing antimicrobial liquids that include volatile active ingredients, many other compositions may be dispensed from the dispenser 30. Preferably, the reservoir is provided by bottle 36 which is shown in FIGS. 10 and 11.

The actuator 196 of the bracket/actuator assembly 34 is preferably controlled without hand or arm contact with the dispenser 30 to reduce the risk of contamination due to actuation of the dispenser 30. For example, FIG. 1 illustrates a foot actuated pneumatic bladder pump 220 with an air hose 221 adapted to be connected to port 214. The bladder pump 220 may optionally be used to move the actuator 196 from the retracted position to the extended position by delivering pneumatic pressure to the bracket/actuator assembly 34 when depressed by the operator. Alternatively, a wide variety of structures may be used to operate the bracket/actuator assembly 34 without hand contact. To activate the dispenser 30, a wide variety of devices may be used which are designed to engage a user's foot, knee, elbow or even the user's hand. Optionally, an electronic eye may be used to activate the dispenser 30. Additionally, a wide variety of devices may be used to propel the actuator 196 between the retracted and extended position. For example, the actuator 196 may be propelled by a fluid (e.g. pneumatic or hydraulic), a mechanical device, an electromechanical device or an electro/fluid device. Examples of fluid driven devices include molded bulbs, bladders, bellows and cylinders. Examples of mechanical devices include linkages, cables and foot pedals. Electromechanical devices include motors and solenoids with and without mechanical linkages. An example of an electrofluid device includes an electric compressor.

The container assembly 32 includes a valve assembly (described in greater detail below) which includes an outlet 42 that is sized and shaped to afford passage of product to be dispensed (e.g. a circular opening with a diameter of about 0.094 inches), and a pump that is operatively associated with the actuator 196 to dispense product through the outlet 42.

Preferably, the pump for the dispenser 30 comprises a constant volume pump adapted to deliver reproducible, metered amounts of the product regardless of the product volume (e.g. fluid level) in the reservoir. The pump comprises a piston 98 which includes a driven means in the form of driven surfaces 164 for receiving the actuator 196. More preferably, the pump is capable of delivering a precise volume with each actuation. This feature is particularly preferred if the dispenser 30 is utilized to deliver a product whose efficacy, performance or effectiveness is dependent upon the volume delivered to the user. Controlling the volume of product delivered by the dispenser 30 also helps ensure that product is not wasted. Alternatively, the dispenser may function with a pump that varies the volume of product delivered.

The container assembly 32 includes a pair of channels 138 and 140 which are sized and shaped to cooperatively receive the mounting flanges 200 and 202 of the bracket/actuator assembly 34 to attach the container assembly 32 to the bracket/actuator assembly 34 and to align the driven surfaces 164 of the piston 98 with the actuator 196 when the container assembly 32 is attached to the bracket/actuator assembly 34. Engagement between the mounting flanges 200 and 202 and the channels 138 and 140 not only attaches the container assembly 32 to the bracket/actuator assembly 34, but also properly orients the actuator 196 and piston 98 to afford proper operation of the dispenser 30.

Figure 3:
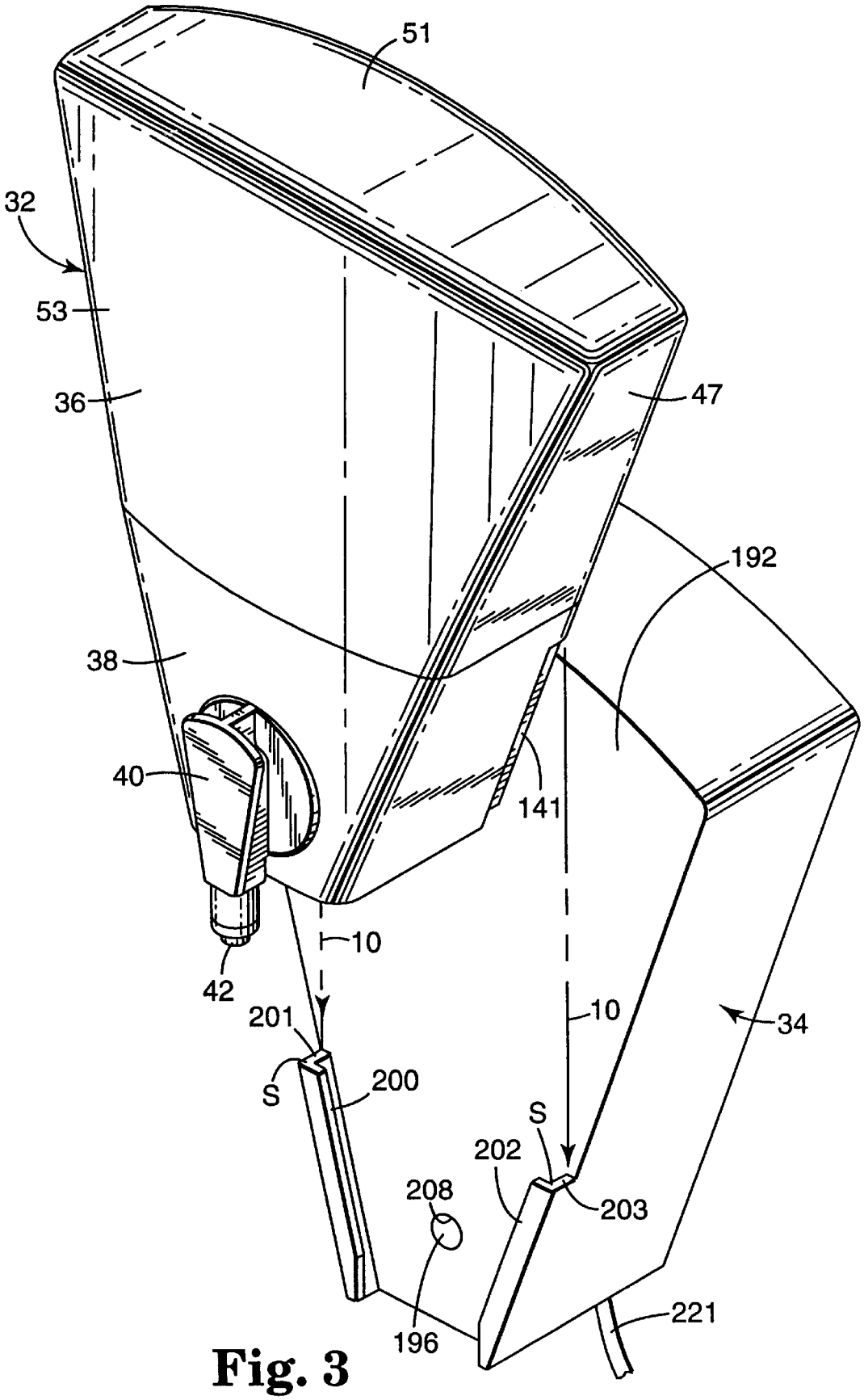
FIG. 3 is a perspective view of the container assembly separated from the bracket/actuator assembly which illustrates the direction of attachment of the container assembly onto the bracket assembly.
Figure 4:
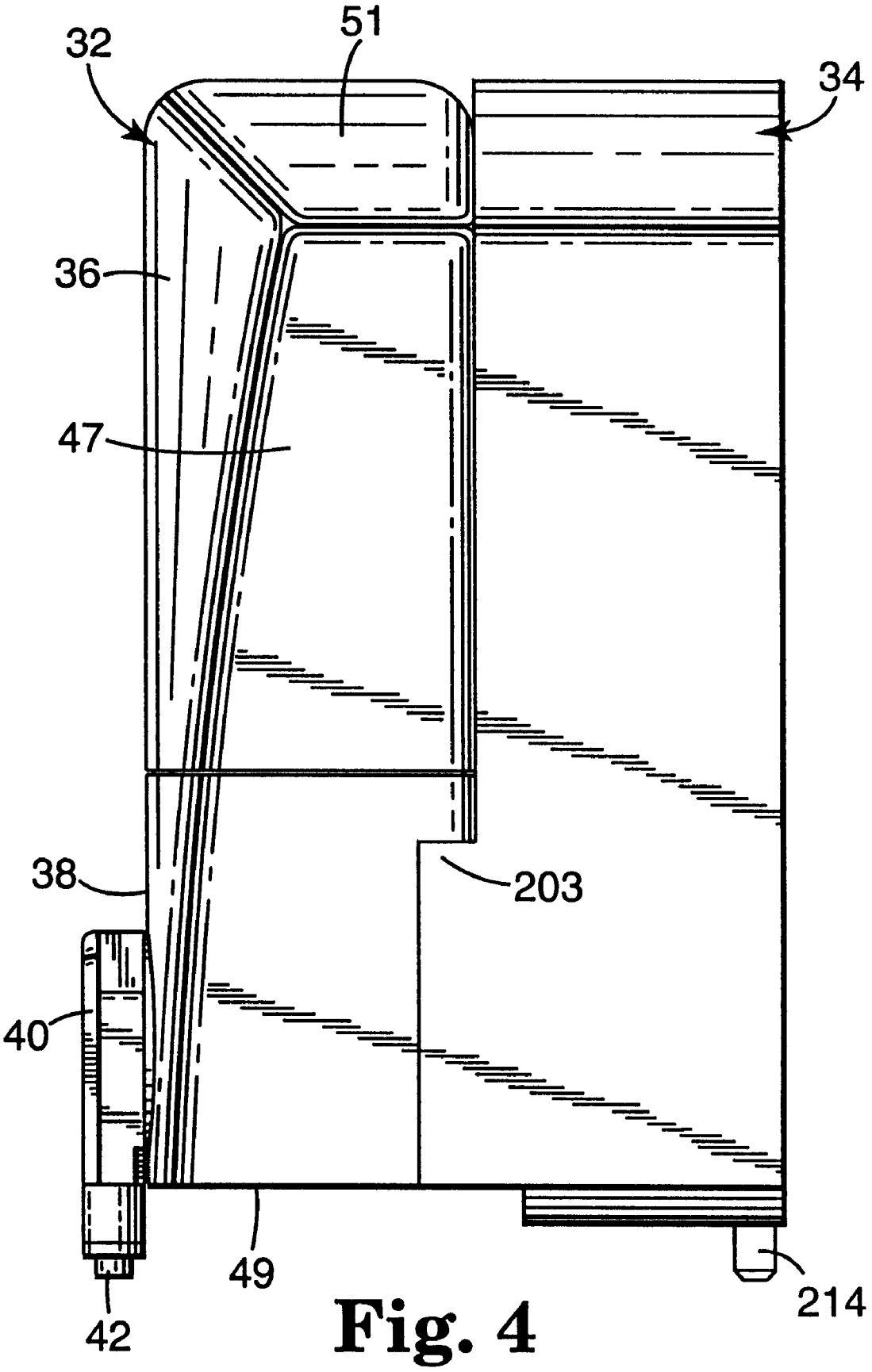
FIG. 4 is a right side view of the container and bracket/actuator assemblies shown in FIG. 2, with the valve assembly shown in a dispense position.

The container assembly 32 is quickly attachable to the bracket/actuator assembly 34 in a vertically downward direction (see arrows 10 in FIG. 3). Conveniently, to assembly the dispenser 30, the operator may simply drop the container assembly 32 into the bracket/actuator assembly so that the flanges 200 and 202 engage the channels 138 and 140. This relatively simple task does not require excessive handling with the attendant contamination risks. Set up, maintenance and refilling of the dispenser 30 may be rapidly accomplished without the need for complicated steps or excessive handling.

Preferably, the channels 138 and 140 are elongate and situated to taper toward each other in the direction of attachment 10 (FIG. 3) so that the driven surfaces 164 of the piston 98 are automatically guided into a predetermined orientation relative to the actuator 196 upon attachment of the container assembly 32 to the bracket/actuator assembly 34. Automatic orientation of the driven surfaces 164 and actuator 196 eliminates the need to carefully manipulate those elements into a proper orientation. As an example not intended to be limiting, the channels 138 and 140 may be situated to form an acute angle of about forty (40) degrees therebetween, and a vertical height of about 2.1 inches.

The container assembly 32 preferably includes a substantially planar rear wall 39 which is adapted to abut a substantially planar front housing 192 of the bracket/actuator assembly 34 when the dispenser 30 is assembled. Should the operator so desire, to assemble the dispenser 30, the rear wall 39 may be placed against the housing 192, and the container assembly 32 slid downwardly until the flanges 200 and 202 engage the channels 138 and 140.

Figure 7:
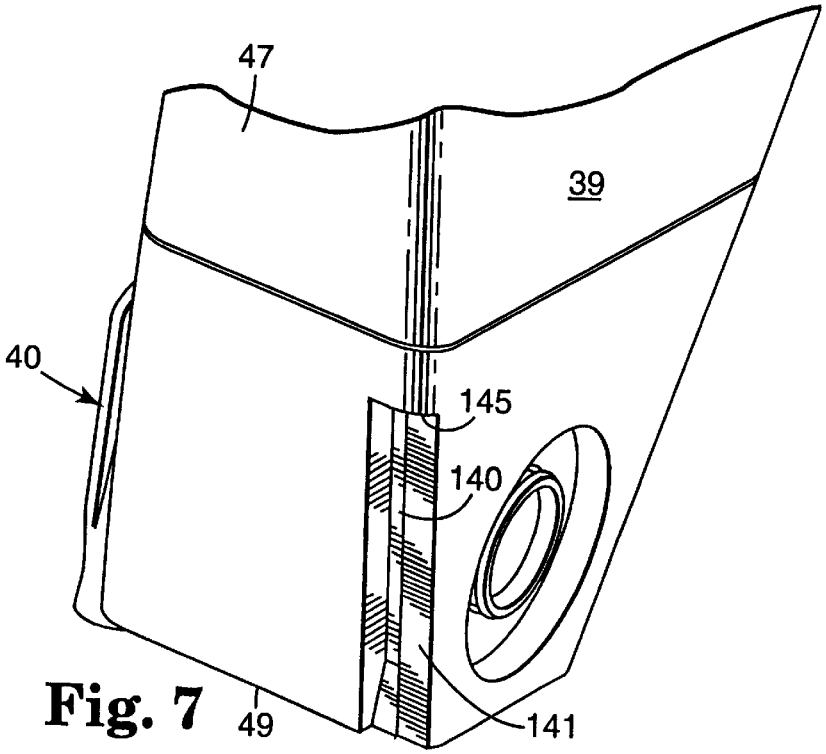
FIG. 7 is a perspective view of a portion of the container assembly.
Figure 8:
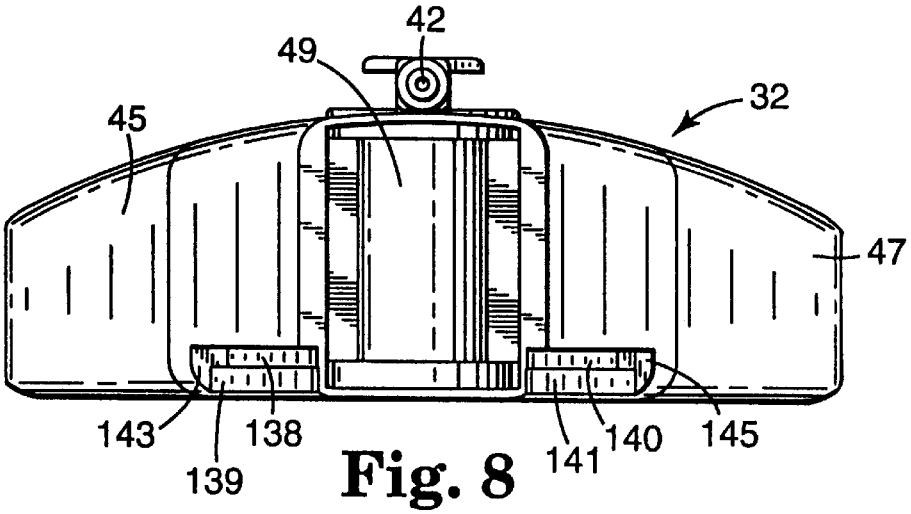
FIG. 8 is a bottom view of the container assembly.
Figure 9:
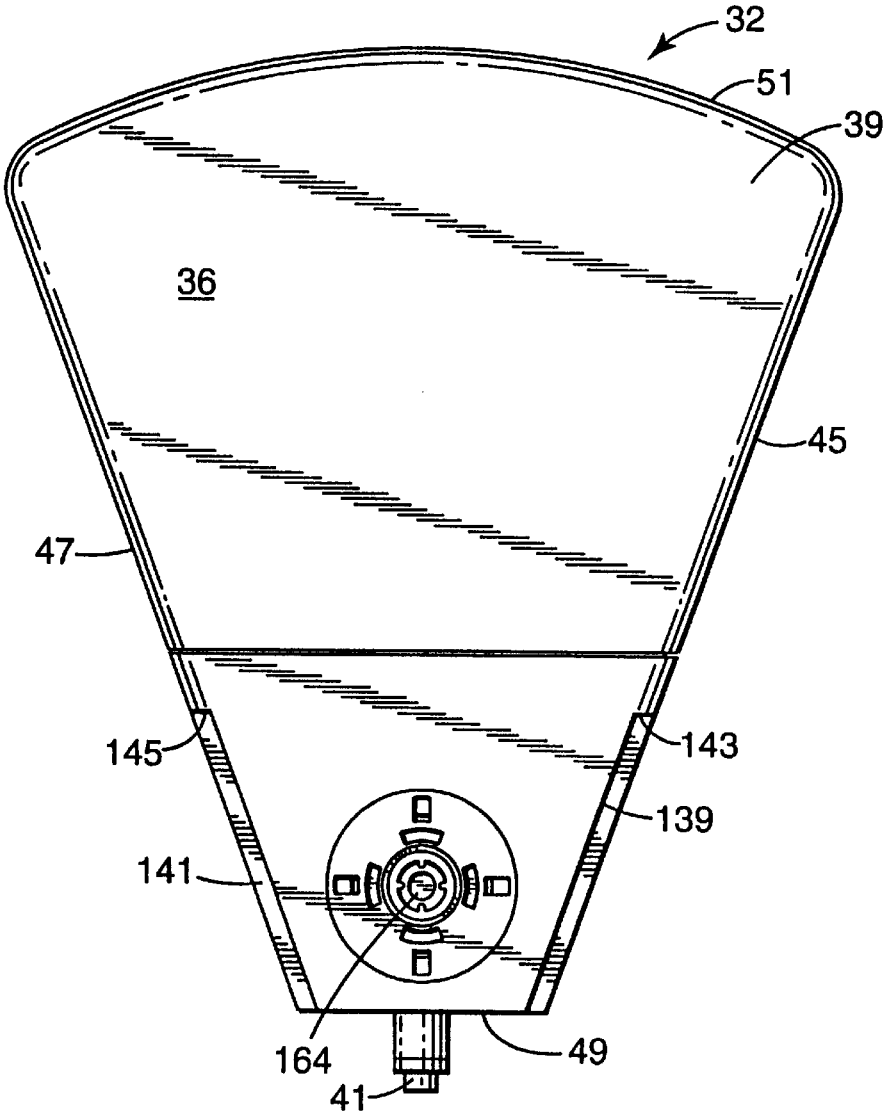
FIG. 9 is a rear view of the container assembly.

The container assembly 32 includes a top wall 51, a front wall 53, a pair of side walls 45 and 47 which taper toward each other in the direction of attachment, and a bottom wall 49. Each of the side walls 45 and 47 include one of the channels 138 and 140. Referring to FIG. 7, there is shown a bottom, rear portion of the side wall 47. The channels (e.g. 140) are preferably located in the bottom, rear portion of a side wall (e.g. 47).

The dispenser 30 preferably has surfaces which are substantially free of sudden discontinuities to afford ease of cleaning and to reduce the potential for accumulation of contaminants on the dispenser 30. The top 51, front 53, side 45 and 47 and bottom 49 walls of the container assembly 32 have surfaces which are substantially free of sudden discontinuities to afford ease of cleaning. Further, the top, side and bottom walls of the bracket/actuator assembly 34 form a shape that is substantially identical to the shape of the container assembly 32 to provide a dispenser 30 which is substantially free of discontinuities. The shape of the dispenser 30 is not a complex geometry which contributes to the ease with which the dispenser 30 may be cleaned.

Preferably, the top 51 and front 53 walls have outer surfaces that are slightly curved while the side walls 45 and 47 are substantially flat. As an example not intended to be limiting, the front wall may have a radius of about six inches and the top wall 51 may have a radius of about six inches.

The dispenser 30 is preferably relatively flat so that it presents a low profile which reduces the chances of it being inadvertently bumped, dislodged, or knocked over. To this end, the container assembly 32 is preferably relatively flat. As an example not intended to be limiting, the thickness of the container assembly 32 (the distance between the rear wall 39 and the front wall 53) should be less than about two inches.

Also preferably, the flanges 200 and 202 project inwardly from support arms 201 and 203. The container assembly 32 includes recessed ledges 139 and 141 adjacent the channels 138 and 140. The ledges 139 and 141 are recessed from the rest of the side walls 45 and 47 by an amount that is substantially the thickness of the support arms 201 and 203 so that there is a substantially flush interface or junction between the container assembly 32 and the bracket actuator assembly 34 to reduce the surfaces which may collect contaminants or which may be difficult to keep clean.

The channels 138 and 140 each have first ends opening onto the bottom wall 49 and second ends defined by shoulder surfaces 143 and 145 which are adapted to engage stop surfaces S of the mounting flanges 200 and 202 and support arms 201 and 203. Engagement between the stop surfaces S and the shoulder surfaces 143 and 145 terminates the insertion of the container assembly 32 into the bracket/actuator assembly at the point where actuator 196 is properly oriented with the driven surfaces 164 of the piston 98.

The container assembly 32 has a product path between the reservoir and the outlet 42. Preferably, the container assembly 32 is disposable and the product path is located entirely within the container assembly 32 so that the entire product path is disposed of upon disposal of the container assembly 32. In this manner, the dispenser 30 avoids accumulation of contaminants within the product path. Alternatively, however, the container assembly 32 or portions thereof may be reusable.

Within the product path and between the outlet 42 and the reservoir, the container assembly 32 includes a valve assembly with inner surfaces which receive the piston 98 and define a pump chamber 90. The valve assembly includes outer surfaces 83 including sealing surfaces 84 for sealing the reservoir, grasping surfaces 40 (e.g. a knob) that are sized and shaped to be manually grasped, the outlet 42, and surfaces extending between the inner and outer surfaces 83 to define a fill hole 94. As described in greater detail below, the knob 40 can be turned to permit or prohibit flow of product (e.g. liquid) from the bottle 36 out through nozzle 42.

Figure 2:
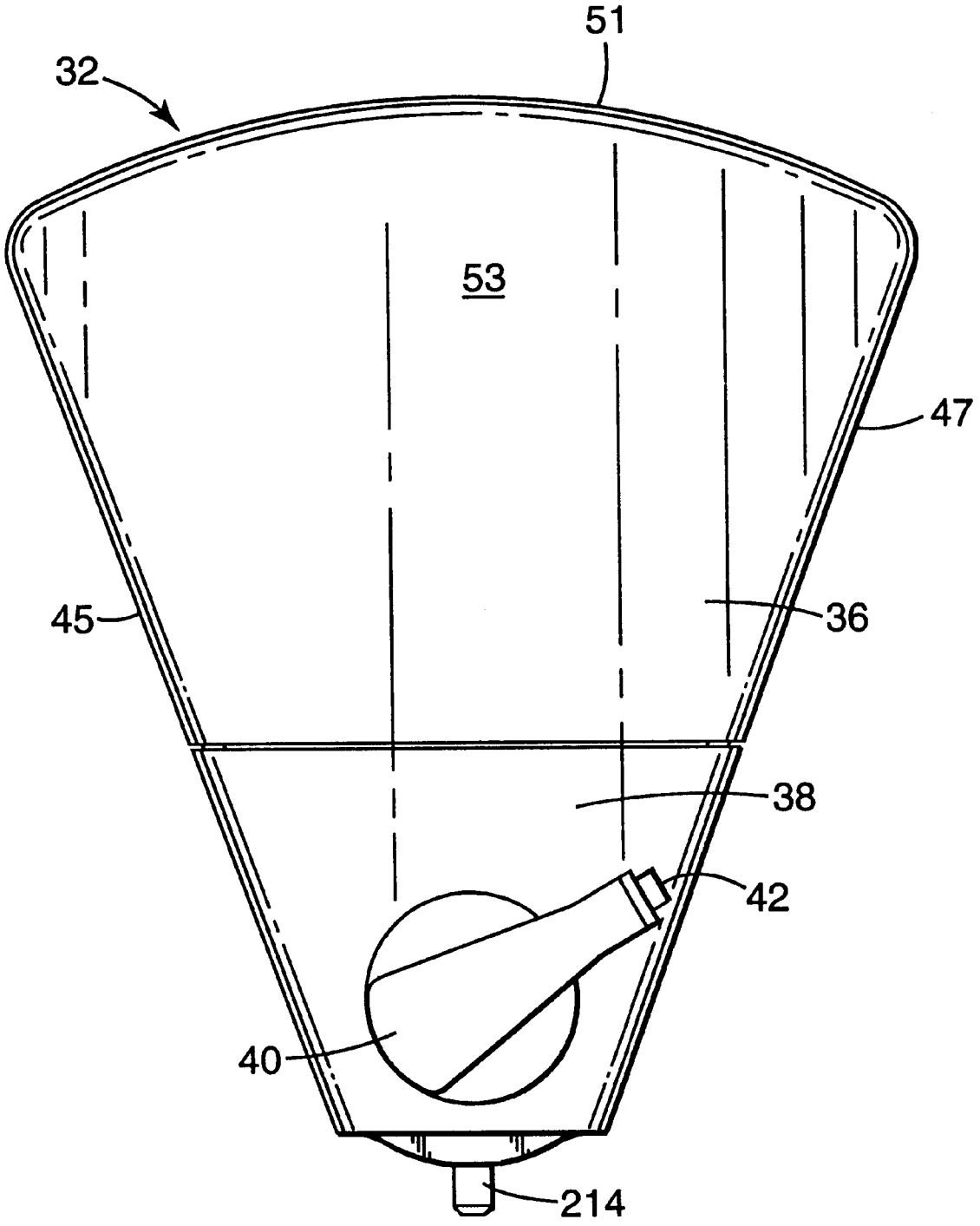
FIG. 2 is a front view of the container and bracket/actuator assemblies of FIG. 1 with the foot actuated pneumatic bladder pump omitted and with a valve assembly shown in a sealed position.

The valve assembly is mounted within the dispenser 30 for movement between a sealed position (FIG. 2) with the sealing surfaces 84 sealing reservoir from the pump chamber 90, and a dispense position (FIGS. 5 and 26–30) with the fill hole 94 affording passage of the product from the reservoir to the pump chamber 90. In the sealed position, the valve assembly provides a positive seal for the reservoir which is particularly convenient for shipping, handling or storage of the container assembly 32.

Figure 27:
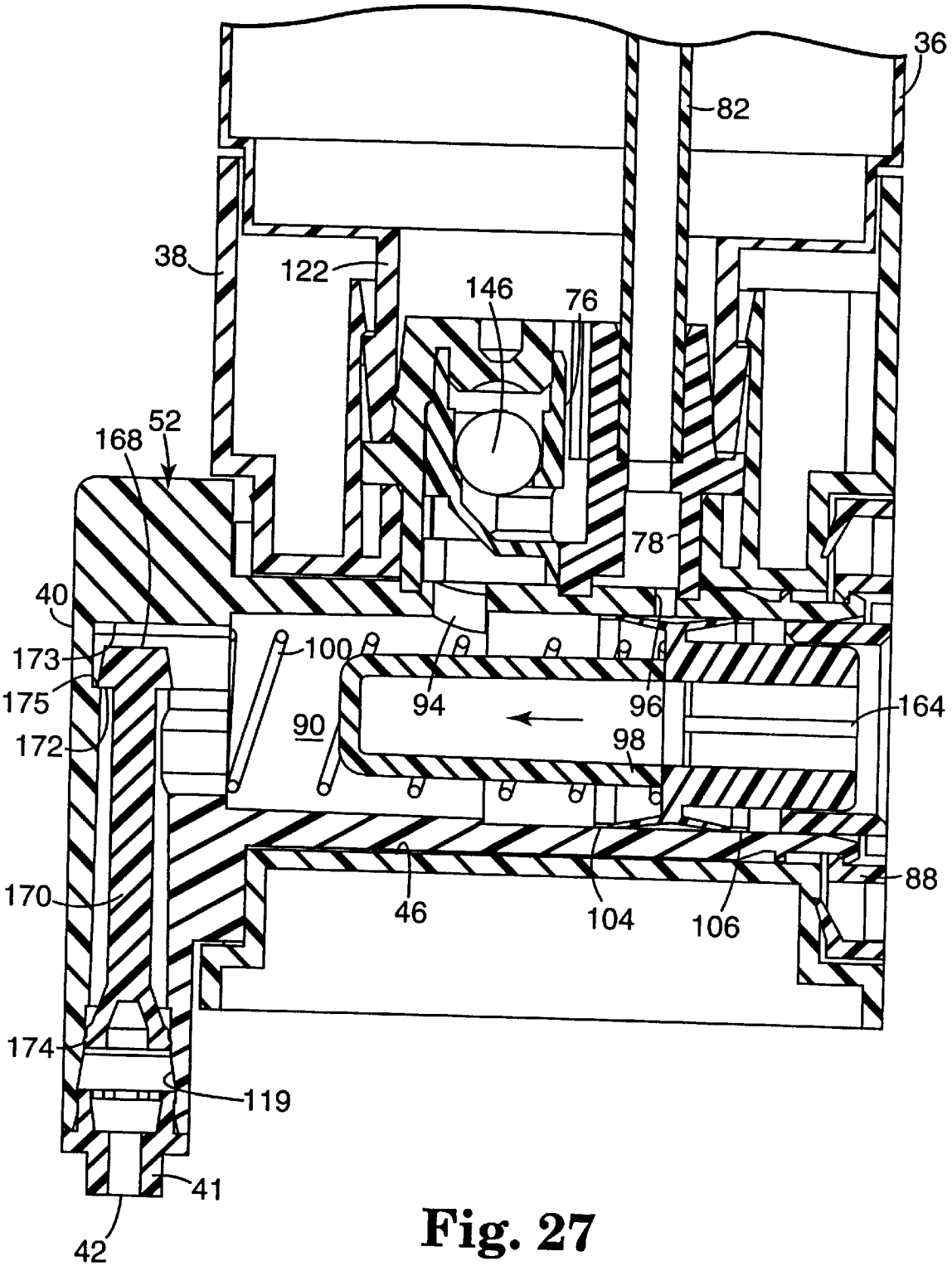
Figure 28:
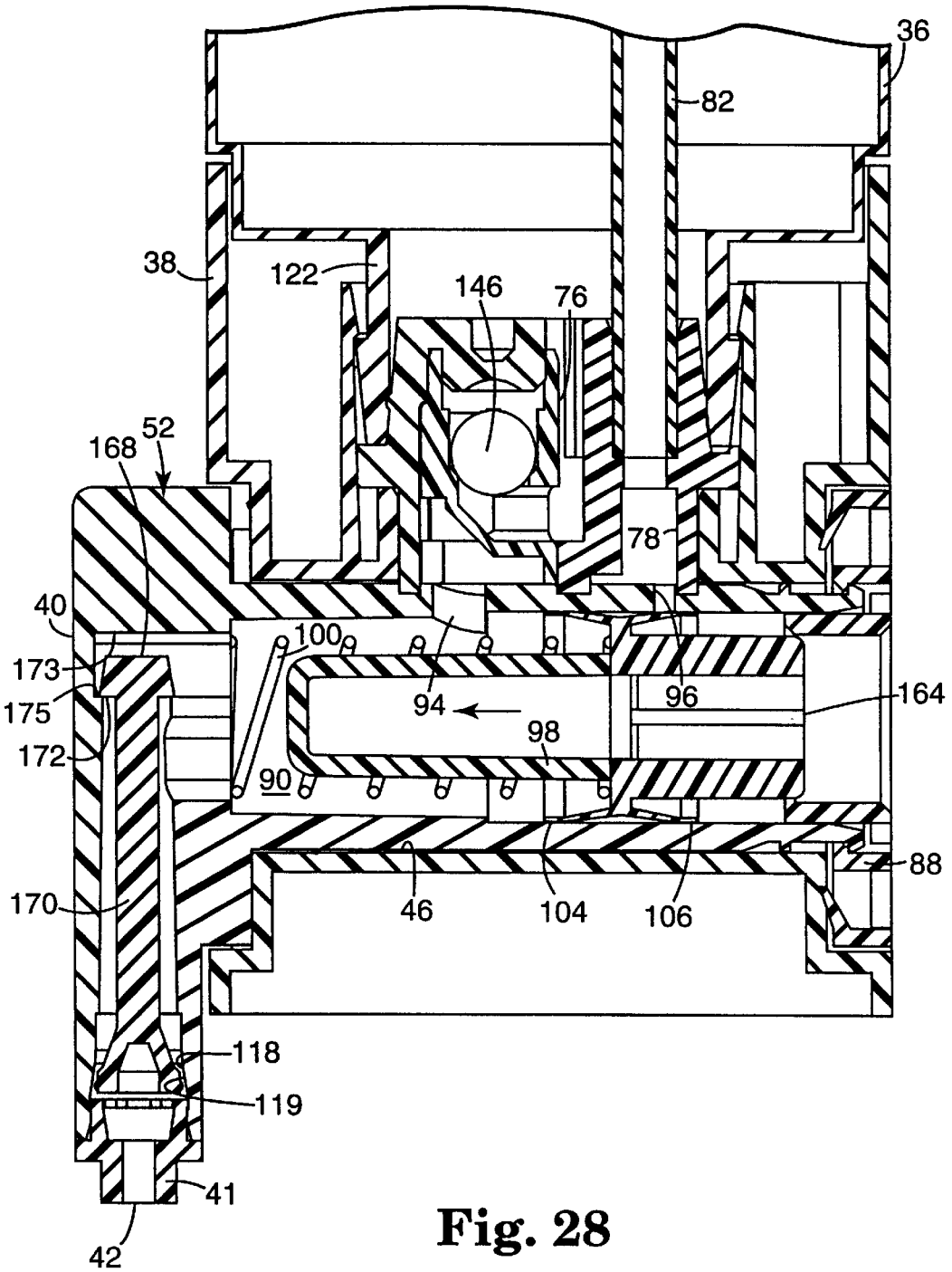
Figure 29:
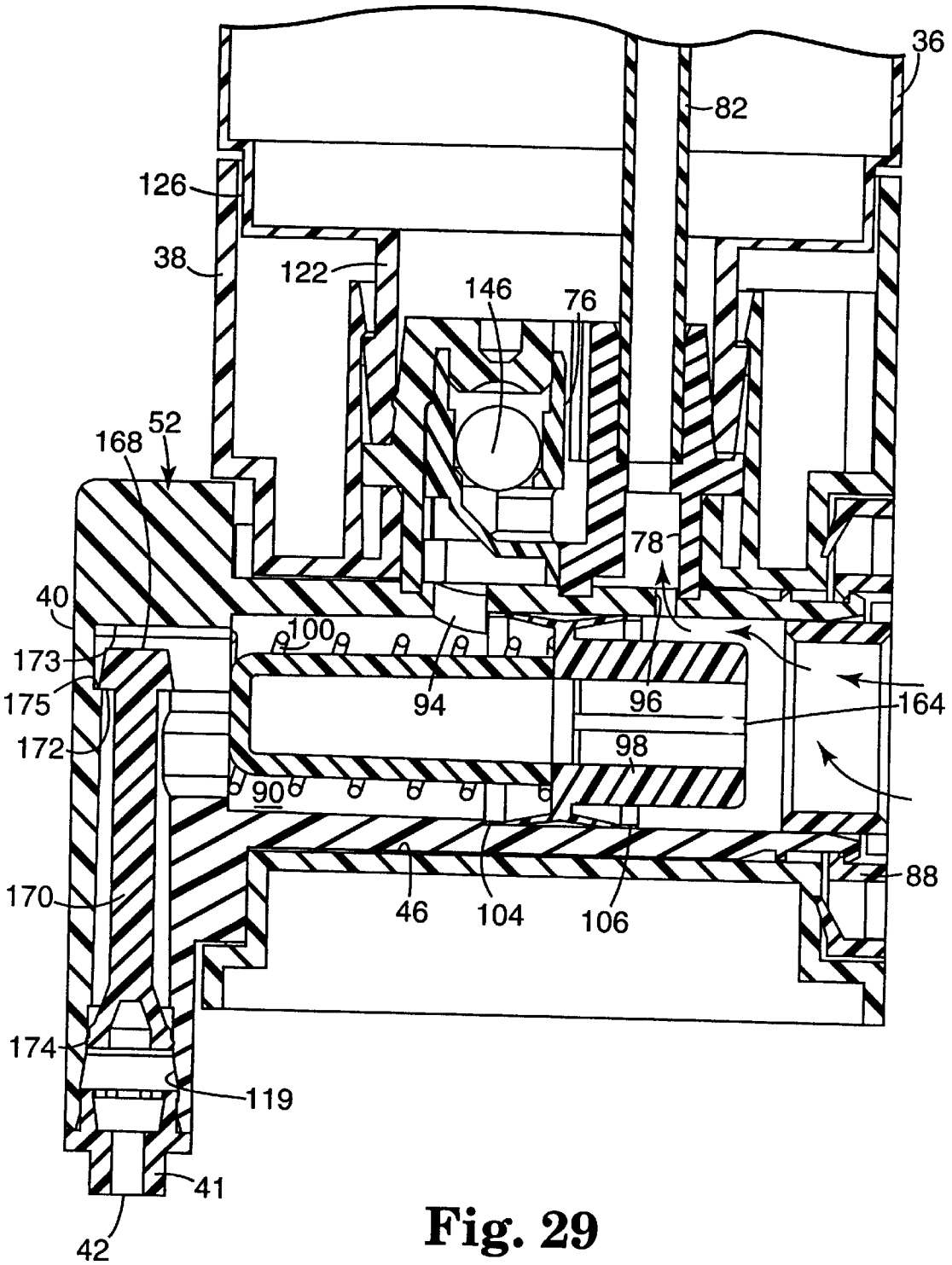

In the preferred embodiment of dispenser 30 shown in FIGS. 26–30, the pump is a constant volume pump. The piston 98 is mounted within the inner surfaces of the valve assembly for movement between a return position (FIG. 26) and an actuated position (FIG. 29). Movement of the actuator 196 from the retracted to the extended position causes the actuator 196 to engage the surfaces 164 of the piston 98 and drive the piston 98 from the return position to the actuated position. Preferably, a spring 100 is mounted within the inner surfaces of the valve assembly to bias the piston 98 toward the return position. The spring 100 also biases the actuator 196 toward the retracted position through the piston 98.

The container assembly 32 includes a cover 38 that is adapted to receive the reservoir. The cover 38 has surfaces defining a passageway 46. Preferably, the valve assembly comprises a spool element 52 (FIGS. 17 and 18) adapted to be received in the passageway 46 of the cover 38. The spool element 52 is mounted to rotate within the passageway 46 between the sealed and dispense positions.

The cover 38 includes a main opening 44 adapted to receive the bottle 36. The passageway 46 has a first end 48 and a second end 50 on opposite faces which receive the spool element 52. The axis of the passageway 46 in the cover 38 is conveniently oriented perpendicular to the main axis of the disposable container assembly 32. First 54 and second 56 hollow coaxial bosses project perpendicularly from the wall of the passageway 46 in the cover 38. The first hollow boss 54 includes a first opening 58 at the top and a second opening 60 into the passageway 46. The second hollow boss 56 includes an opening 62 at the top that is adapted to be connected to the bottle 36. The cover 38 may be constructed from any suitable material, such as, but not limited to high density polyethylene.

In addition to the product fill hole 94, the spool element 52 preferably includes a vent hole 96 which affords passage of replacement air into the reservoir. The vent hole 96 in the spool element 52 is a port for the aspiration of replacement air into the bottle 36.

Figure 5:
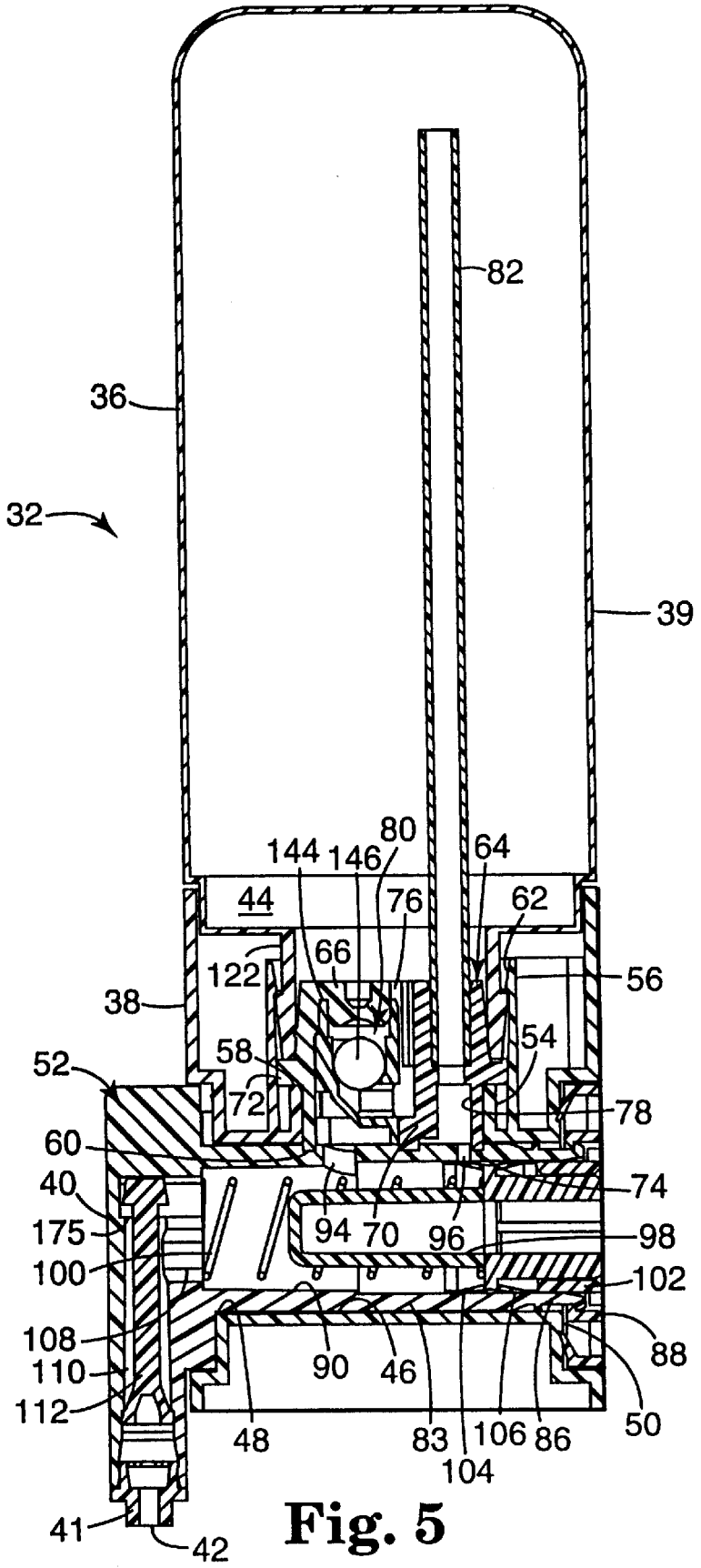
FIG. 5 is a sectional view of the container assembly.
Figure 6:
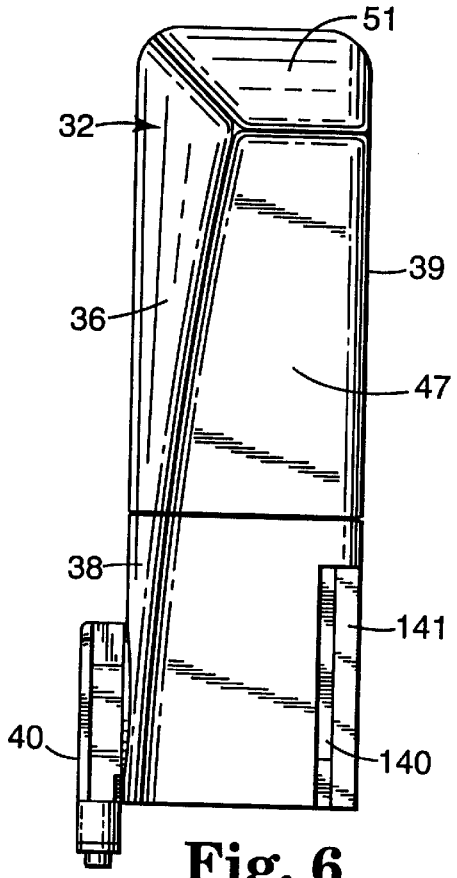
FIG. 6 is a right side view of FIG. 2, with the bracket/actuator assembly omitted to illustrate details of the container assembly.

The reservoir includes a plug 64 having first 76 and second 78 passageways. The first passageway 76 affords passage of product from the reservoir to the pump chamber 90, and the second passageway 78 affords passage of replacement air into the reservoir. Preferably, the plug 64 is constructed from an elastomeric material, but may include an insert 144 (FIG. 5). As an example not intended to be limiting, the majority of the plug 64 may be constructed from a thermoplastic elastomer such as Santoprene 271-64 available from Advanced Elastomer, and with the insert 144 constructed from high density polyethylene. In the sealed position, the sealing surfaces 84 seal the first and second passageways 76 and 78, and in the dispense position, the fill hole 94 is aligned with the first passageway 76 and the vent hole 96 is aligned with the second passageway 78.

The plug 64 is disposed between the bottle 36 and the cover 38. The plug 64 includes a conical top portion 66 that is adapted to seal against the inside surface of a neck portion 122 of the bottle 36, and a bottom portion 70 that is conveniently constructed to fit inside the first hollow boss 54 of the cover 38. The plug 64 also includes an intermediate flange 72 that is adapted to be compressed between the end of the bottle neck 122 and the top of the first hollow boss 54 in the cover 38. The bottom portion 70 of the plug 64 is constructed to include a cylindrical surface with a diameter substantially equal to that of the passageway 46 in the cover 38. When the plug 64 is compressed between the bottle 36 and the cover 38, the bottom surface 74 of the plug 64 projects slightly into the passageway 46 of the cover 38 and seals against spool element 52.

The passageways 76 and 78 communicate between the interior of the bottle 36 and the spool element 52. Preferably, the first passageway 76 includes a one-way valve 80 for preventing flow of product from the pump chamber 90 to the reservoir. The illustrated one-way valve 80 comprises a ball valve having a ball 146. The ball valve may be constructed from the insert mentioned above.

The ball 146 is movable between an open position (FIG. 30) which affords passage of product from the reservoir to the pump chamber 90, and a closed position (FIGS. 26–29) which prevents flow of product from the pump chamber 90 to the reservoir. In a preferred set up, the bottle 36 is situated above the outlet 42 when the dispenser 30 dispenses product, thus, gravity biases the ball 146 toward the closed position. The dispenser 30 is capable of completely dispensing substantially all of the product within the bottle 36, at least partly due to the location of the bottle 36 above the pump.

Dispensing substantially all of the product within bottle 36 helps reduce wastage of product upon disposal of the container assembly 32.

The second passageway 78 is adapted to provide a vent 82 for the entrainment of replacement air into the bottle 36. The piston 98 includes first and second piston seals 104 and 106 which are situated to seal the vent hole 96 when the piston 98 is in the return position, and to afford passage of ambient air through the vent hole 96, the second passageway 78, vent tube 82 and into the reservoir when the piston 98 is in the actuated position.

The spool element 52 is adapted to closely fit in the passageway 46 of the cover 38 and includes a hollow cylindrical portion with a first end 86 that is adapted to connect to a retaining element 88 (FIGS. 22 and 23), a second end that comprises the knob 40, and the pumping chamber 90. The retaining element 88 axially holds the spool element 52 in the passageway 46 of the cover 38 but permits rotation thereof. In the sealed position of the valve assembly (particularly useful for shipping, handling and storage), a solid portion (the sealing surfaces 84) of the hollow cylindrical portion of the spool element 52 seals against the elastomeric plug 64 and blocks the first 76 and second 78 passageways that communicate with the liquid in the bottle 36. Notably, the driven surfaces 164 of the piston 98 preferably do not project out beyond the rear wall 39 of the container assembly which helps reduce the chances of inadvertent or undesirable actuation of the container assembly during shipping, storage or handling prior to use.

The inner cylindrical surface of the spool element 52 seals with piston 98. A boss 102 on the retaining element 88 holds the piston 98 in the spool element 52. In the return position of the piston 98, the vent hole 96 in the spool element 52 is closed between first 104 and second 106 piston seal surfaces. During movement of the piston 98 from the return to the actuated position, product (e.g. liquid) in the pump chamber 90 flows through a port 108 that connects with an outlet tube 110 which ends at outlet 42. At least at the end of the movement of the piston 98 to the actuated position, the vent hole 96 is open to the atmosphere.

The dispenser 30 preferably includes a drip resistant nozzle. The nozzle includes portions of the outlet tube 110 which includes the outlet 42, and a flexible, resilient member 112. The flexible, resilient member 112 has a seal portion 174 adapted to engage inner surfaces of the outlet tube 110 to seal the outlet 42 relative to the pump chamber 90.

The flexible, resilient member 112 prevents air aspiration into the pump chamber 90 when the pump chamber 90 is filled with product (e.g. a liquid) from the reservoir. The flexible, resilient member 112 also helps reduce the amount of unsealed liquid which is left adjacent the outlet 42 after a metered amount of the liquid is dispensed. This helps reduce contamination build up as there is less unsealed liquid adjacent the outlet 42 which may attract dirt, dust and other contaminants. Reducing the amount of unsealed liquid adjacent the outlet 42 diminishes the chance that dried liquid will clog or occlude the outlet 42 and also reduces the chance that any unsealed, undispensed liquid will drip from the outlet 42 at an inopportune time (e.g. between discharges of liquid).

Figure 26:
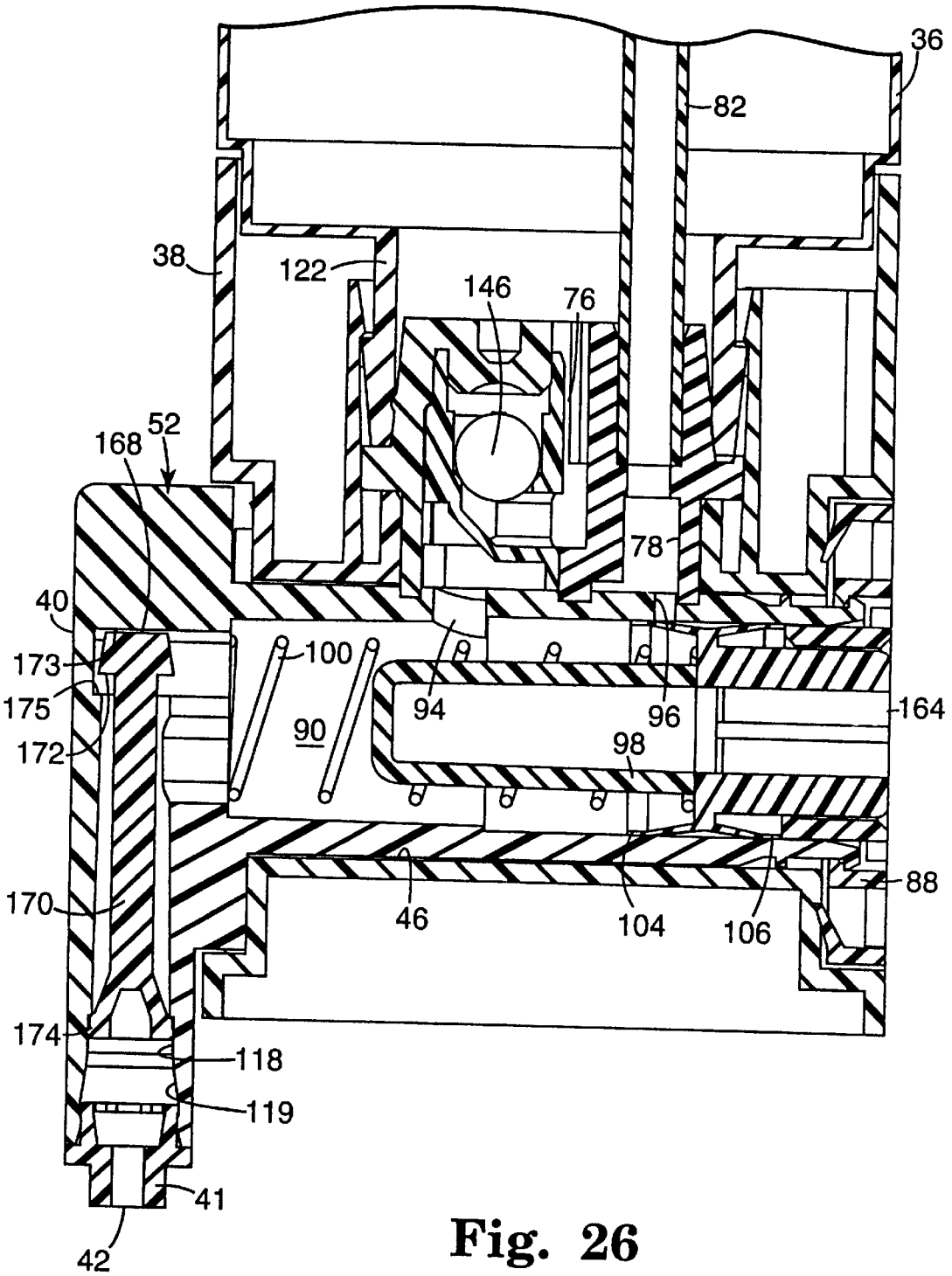
Figure 30:
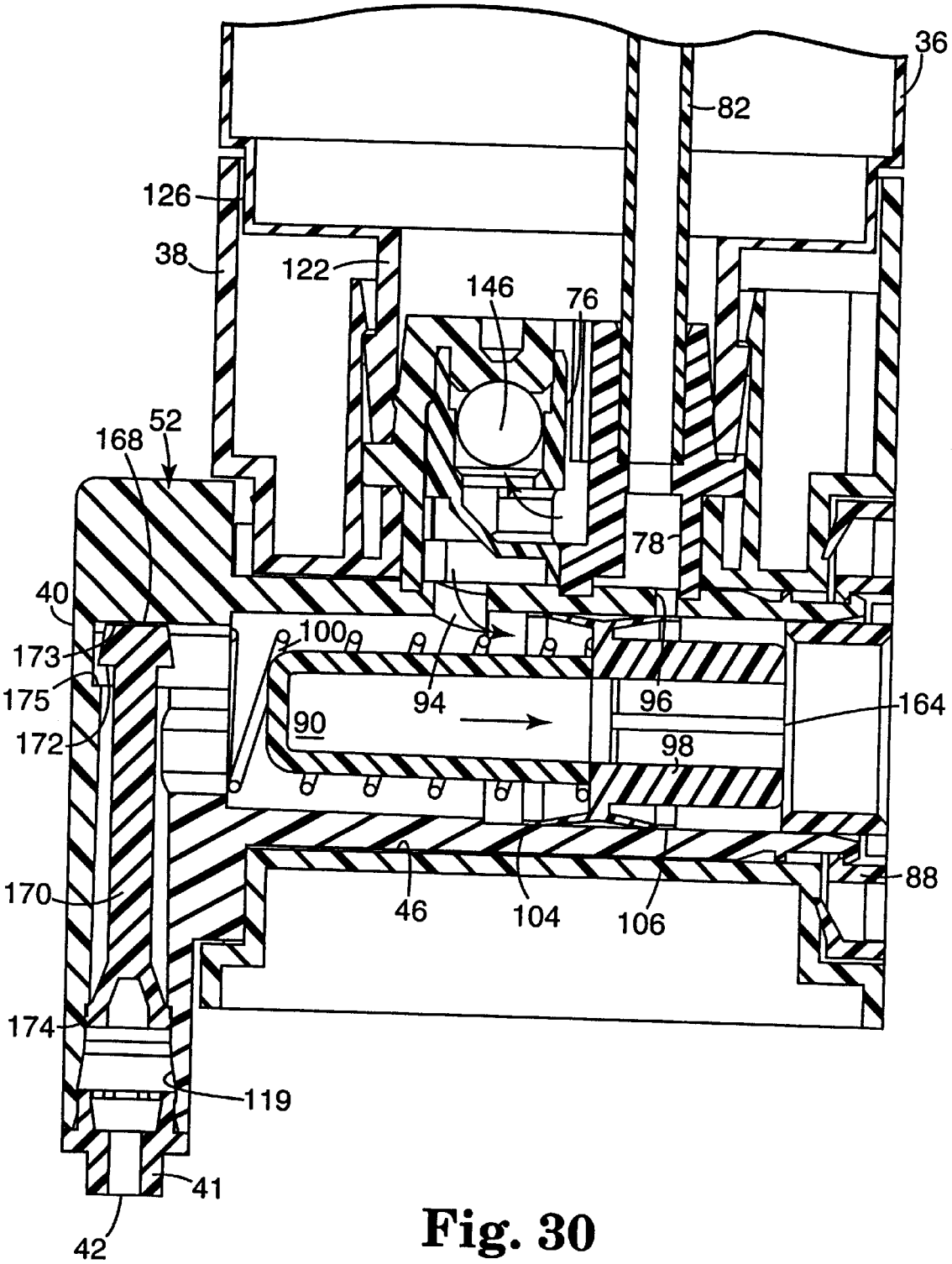

Referring to FIGS. 26–30, the flexible, resilient member 112 is mounted within the inner surfaces of the nozzle for movement between a) a relaxed position FIGS. 26 and 30) with the seal portion 174 engaging a portion of the inner surfaces of the nozzle to seal the outlet 42 relative to the pump chamber 90, b) a displaced sealing position (FIGS. 27 and 29) in which the seal portion 174 is spaced from the relaxed position and in which the seal portion 174 engages a different portion of the inner surfaces of the nozzle to seal the outlet 42 relative to the pump chamber 90, and a deflected, dispense position (FIG. 28) with the seal portion 174 of the flexible, resilient member 112 spaced from engagement with the inner surfaces of the nozzle to afford flow of the product to be dispensed from the pump chamber 90 through the outlet 42. Movement of the flexible resilient member 112 from the deflected, dispense position (FIG. 28) toward said relaxed position (FIG. 29) tends to urge the unsealed, undispensed product from the outlet 42 back into the nozzle and away from the outlet 42.

Figure 21:
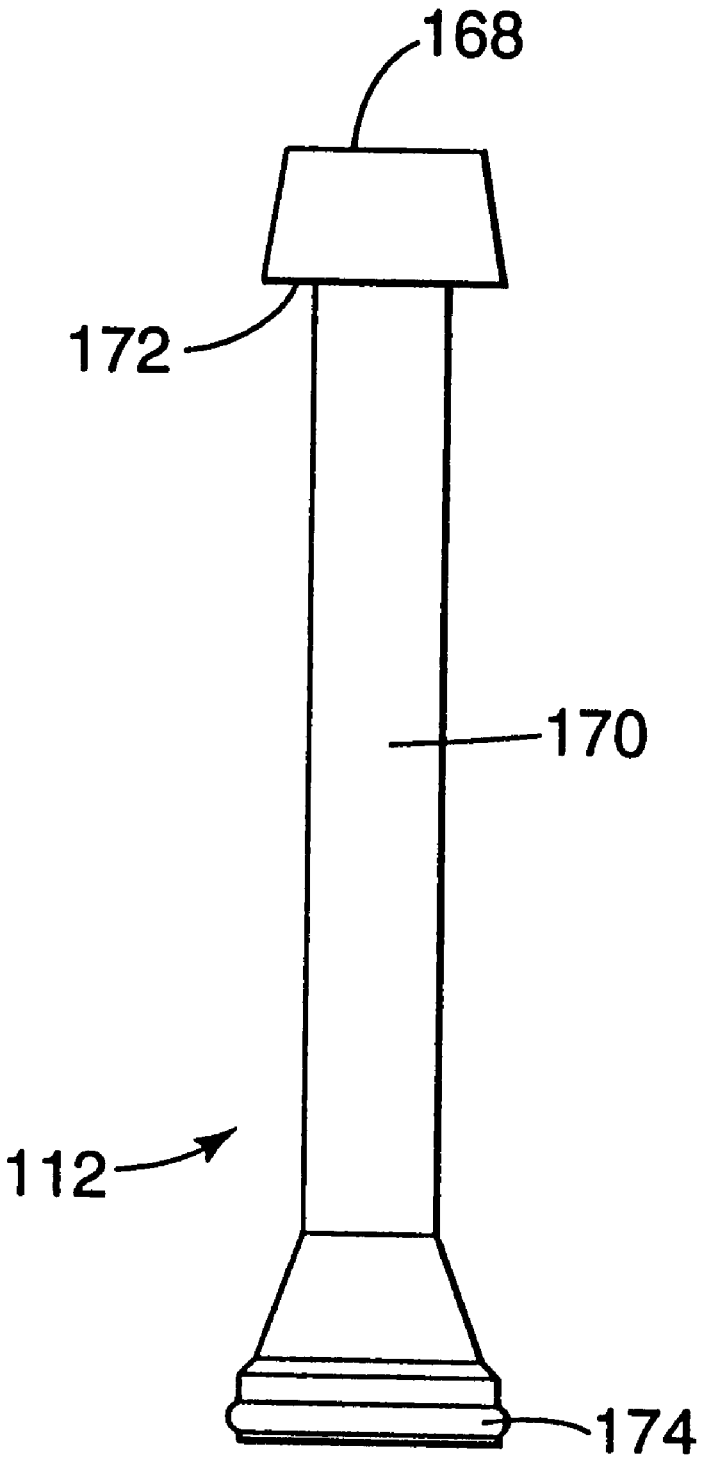
FIG. 21 is a side view of a optional flexible, resilient member for use in the container assembly.

A relaxed shape of the flexible, resilient member 112 is shown in FIGS. 21 and 26. The flexible, resilient member 112 is elongate in an axial direction and includes a seating portion having a first end 168 and retaining surfaces 172 spaced from the first end 168. Between the relaxed position (FIG. 26) and the displaced sealing position (FIG. 27), the flexible resilient member 112 is preferably physically displaced to a different location within the nozzle without being deformed or deflected from its relaxed shape. Between the displaced sealing position (FIG. 27) and the deflected, dispense position (FIG. 28), the flexible resilient member 112 preferably stretches axially to deform from its relaxed shape.

The inner surfaces of the nozzle include a base surface 173 for receiving the first end 168 of the flexible, resilient member 112 in the relaxed position (FIGS. 26 and 30), and a stop surface 175 which is spaced from the base surface 173 to afford displacement of the flexible resilient member 112 from the relaxed position to the displaced sealing position by pressure within the pump chamber 90. For example, the surfaces 173 and 175 may be spaced from each other about 0.19 inches. Alternatively, but not shown in the preferred embodiment, the seating portion of the member 112 may be fixed relative to the nozzle so that pressure within the pump chamber 90 deflects the flexible resilient member 112 from the relaxed position to the displaced sealing position.

Pressure within the pump chamber 90 and engagement between the retaining surface 172 and the stop surface 175 cause the flexible, resilient member 112 to deflect by stretching axially to afford movement of the flexible, resilient member 112 from the displaced, sealing position (FIG. 27) to the deflected, dispense position (FIG. 28). The flexible resilient member 112 is urged back from the deflected, dispense position (FIG. 28) toward the displaced, sealing position (FIG. 29) by the resiliency of its material.

As best seen in FIGS. 26–30, the inner surfaces of the outlet tube 110 of the nozzle are elongate in an axial direction and have a cross section along the axis. The cross section of the inner surface 118 of the outlet tube 110 which is immediately adjacent the sealing portion 174 of the flexible, resilient member 112 in the displaced, sealing position (FIG. 27) is smaller than the cross section of the inner surface 119 of the outlet tube 110 which is immediately adjacent the sealing portion 174 of the flexible, resilient member 112 in the deflected, dispense position (FIG. 28). Preferably the inner surface 118 comprises a cylindrical portion having a substantially constant cross-sectional diameter (e.g. about 0.25 inches). The cylindrical portion is adapted to engage the sealing portion 174 of the flexible, resilient member 112 in the relaxed position (FIGS. 26 and 30) and the displaced, sealing position (FIGS. 27 and 29). The inner surfaces 119 include an enlarged portion (e.g. tapering out to a diameter of about 0.29 inches) substantially adjacent the cylindrical portion 118.

The seating portion of the member 112 has a cross sectional area along its axis, and a central shaft portion 170 between the seating portion and the sealing portion 174. The central shaft portion 170 has a cross sectional area along the axis. The sealing portion 174 of the flexible resilient member 112 comprises a substantially cylindrical surface having a diameter defining a cross sectional area along the axis. Preferably, the cross sectional area of the central shaft portion 170 is substantially less than the cross sectional areas of both the seating portion and the sealing portion 174 to afford axial stretching of the flexible, resilient member 112. The seating portion of the member 112 is capable of being snapped through a partition in the outlet tube 110 during assembly of the container assembly 32. As an example not intended to be limiting, the seating portion may be cylindrical with a maximum outer diameter of about 0.22 inches and a thickness of about 0.12 inches; the central shaft portion may be cylindrical with a diameter of about 0.125 inches and a length of less than about 1 inch, and the sealing portion may be frusto-conical with a maximum diameter of about 0.26 inches with a taper of about forty five degrees relative to its longitudinal axis.

During movement of the piston 98 from the return to the actuated position, the flexible, resilient member 112 is first axially displaced and then stretched. In the deflected dispense position of the member 112, an annular flow path is opened between the seal portion 174 and the inner surface 119 of the outlet tube 110. At approximately the time when liquid stops flowing from the pump chamber 90 through the outlet 42, the member 112 relaxes from the deflected, dispense position to its relaxed shape in the displaced, sealing position and circumferentially seals. When the piston 98 moves from the actuated back toward the return position, the member 112 is axially retracted until the first end 168 of the seating portion abuts the base surface 173 of the inner surface of the nozzle. The axial retraction of the sealing portion 174 after it circumferentially seals against the inner surfaces of the nozzle causes any liquid remaining within the nozzle adjacent outlet 42 to be drawn back into the nozzle and away from the outlet 42.

When the piston 98 moves from the return to the actuated position, liquid in the pump chamber 90 flows through a port 108 into the outlet tube 110 in the knob 40. The member 112 controls the direction of flow and helps reduce the amount of unsealed liquid that remains adjacent the outlet 42 that could dry between uses and obstruct the outlet 42. The outlet 42 is preferably provided by an insert 41 that is connected to the distal end of the outlet tube 110 by means of a snap fit, although gluing, staking, or ultrasonic welding could also be used to make the connection.

Referring now to FIGS. 10 and 11, the bottle 36 includes a body portion 120 and neck portion 122 that is adapted to connect to the cover 38. The neck portion 122 of the bottle is adapted to connect to cover 38 by any convenient means; threads are one possibility, or as in the depicted embodiment, the neck portion 122 of the bottle 36 includes an externally projecting lip 124 that connects to cover 38 by means of a snap fit. In the preferred embodiment, the bottle 36 includes a non-circular region 126 that is recessed from the body portion 120. The recessed region 126 is adapted to extend into the cover 38 to prevent rotation of the bottle 36 after assembly with the cover 38. The bottle 36 can be fabricated from any material compatible with the product to be dispensed. In a preferred embodiment, the bottle 36 is fabricated from a blow molded thermoplastic such as, but not limited to high density polyethylene. Optionally, the entire bottle 36 or a portion thereof may be constructed from a transparent or semi-transparent material so that the user may visually determine the amount of product (liquid) that remains in the reservoir.

Figure 12:
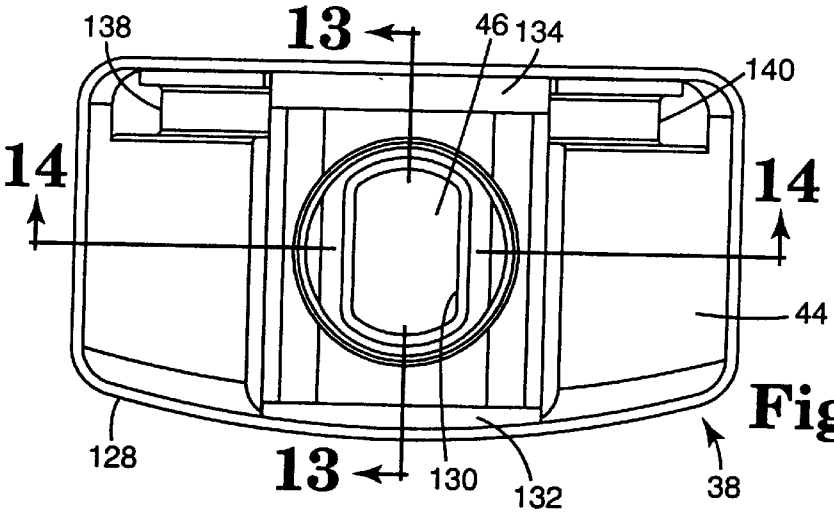
FIG. 12 is a top view of a cover which forms a portion of the container assembly.
Figure 14:
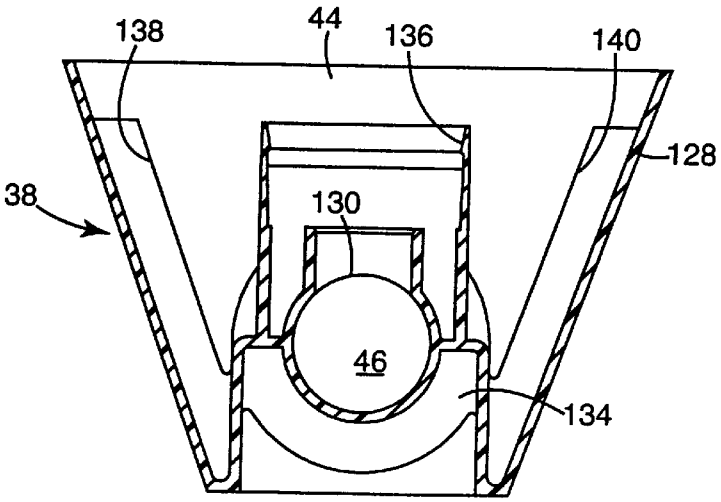
FIG. 14 is a cross-section view of the cover taken substantially along section lines 14—14 in FIG. 12.
Figure 13:
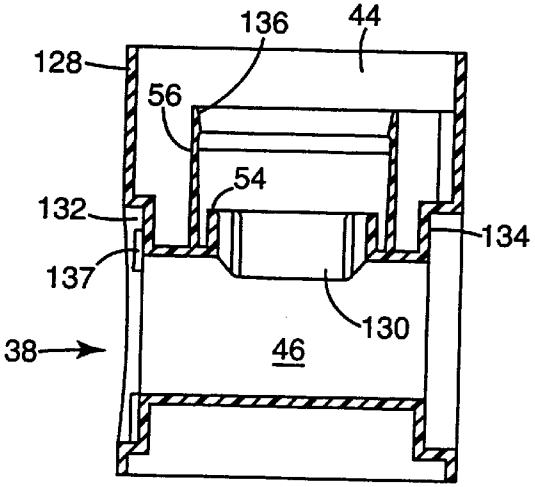
FIG. 13 is a cross-section view of the cover taken substantially along section lines 13—13 in FIG. 12.

Referring to FIGS. 12 through 14, the cover 38 is seen in isolation. The cover 38 includes an exterior body portion with a main opening 44 adapted to receive bottle 36 (not shown in these views for clarity). In the preferred embodiment, the main opening 44 is sized and shaped to receive the recessed region 126 on the bottle 36 (FIG. 10) such that the junction between the bottle 36 and the cover 38 is essentially flush.

A passageway 46 runs substantially perpendicular to the main axis of the bottle 36, and there is an orifice 130 in the passageway 46 that is substantially parallel to the main axis of the bottle 36. The passageway 46 extends completely through the cover 38 and is bounded by a first end 48 on the front face and a second end 50 on the back face. Preferably, the first 48 and second 50 ends are surrounded by first 132 and second 134 countersunk regions. The first countersunk region 132 optionally includes projections 137 that function as a detent or to limit the rotation of the spool element 52. The second countersunk region 134 is adapted to receive retaining element 88.

The cover 38 includes first 54 and second 56 hollow coaxial bosses that project perpendicularly from the passageway 46. The first inner boss 54 surrounds the orifice 130 in the wall of the passageway 46 and is adapted to retain the bottom portion of the plug 64. The top of the first boss 54 is adapted to seat against a flange 72 on the plug 64 and control the distance that the bottom surface of the plug 64 projects into the passageway 46. The second boss 56 connects to the bottle 36 by any convenient means; in the depicted embodiment, the second boss 56 includes an inwardly projecting lip 136 that connects with the externally projecting lip 124 on the bottle 36 by means of a snap fit. The second boss 56 can be continuous or can be slotted so as to control the assembly force of the snap fit joint.

Figure 15:
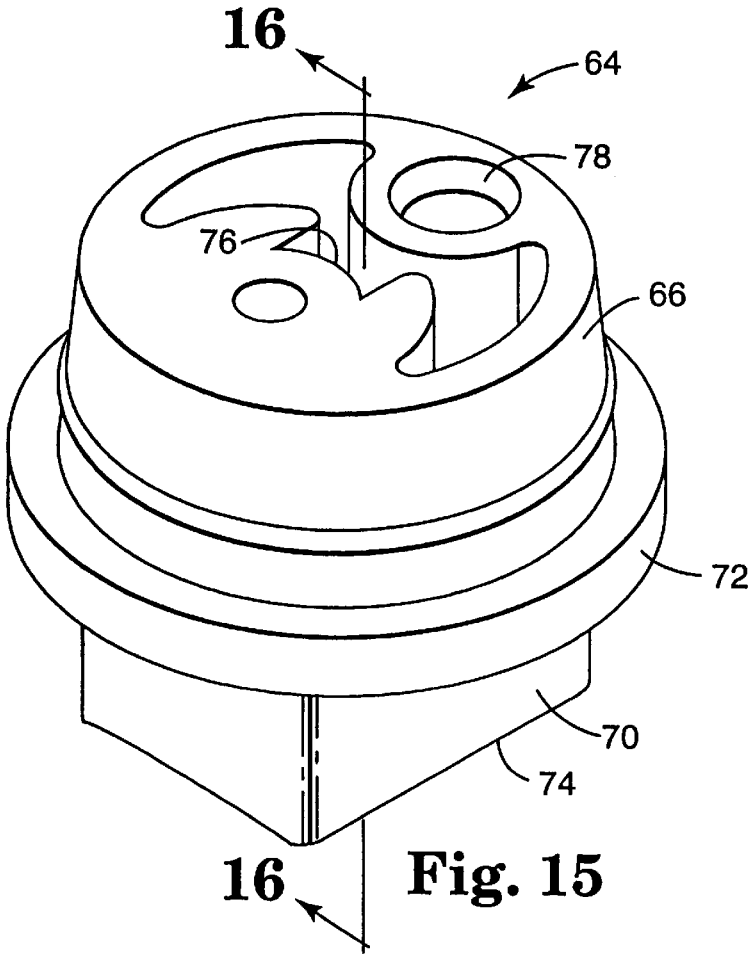
FIG. 15 is a perspective view of a plug which forms a portion of the container assembly.
Figure 16:
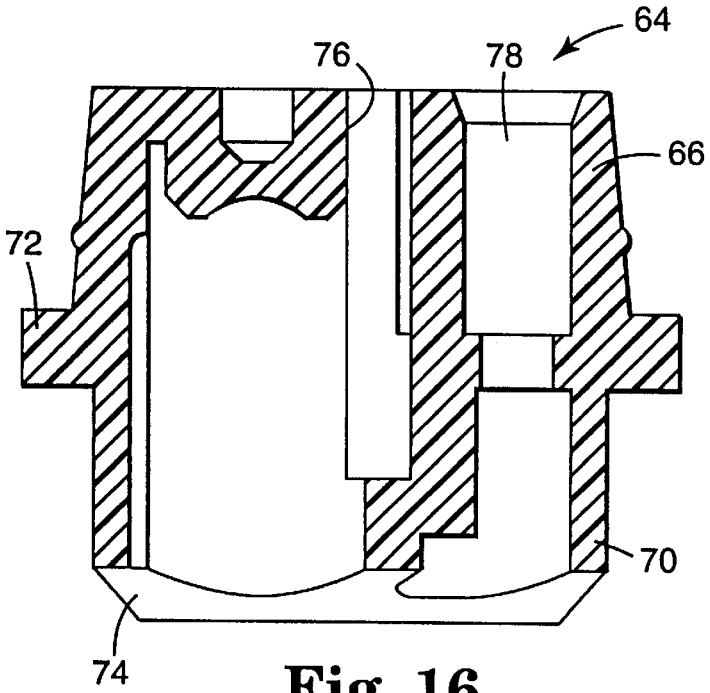
FIG. 16 is a cross-section view of the plug of FIG. 15 taken substantially along section lines 16—16 in FIG. 15, with an insert removed to illustrate other details of the plug.

Referring now to FIGS. 15 and 16, the plug 64 is seen in isolation. The plug 64 includes a top conical portion 66 adapted to seal against the inside of the bottle neck 122, and a bottom portion 70 adapted to fit inside the first boss 54 in the cover 38. The bottom surface 74 is adapted to seal against the spool element 52, and an outwardly projecting flange 72 is adapted to seal between the end of the bottle neck 122 and the top of the first boss 54.

The plug 64 includes an outwardly projecting annular rib (FIGS. 15 and 16) that is intended to improve the seal between the top conical portion 66 and the inside of the bottle neck 122. The one-way valve 80 inserted within first passageway 76 can be of any of several well known types, including valves integrally molded in the elastomeric plug. As depicted in FIG. 5, the presently preferred valve 80 includes valve seat insert 144 and the valve includes a gravity-biased ball 146 or poppet. Alternatively the valve 80 could be a spring-biased ball or poppet sealing against an integral valve seat in the plug 64.

The second passageway 78 in the plug 64 retains a first end of a vent tube 82. The second end of the vent tube 82 is above the normal liquid level in the bottle when the disposable container assembly 32 is mounted in an inverted position on the bracket/actuator 34.

Portions of the plug 64 can be fabricated from any elastomeric material that is compatible with the product to be dispensed. This is can be accomplished by molding from a thermoset elastomer. The portions of the plug shown in FIG. 16 may be injection molded from thermoplastic elastomers (e.g. Santoprene 271-64) with a hardness of 40 to 90 Shore A.

Figure 17:
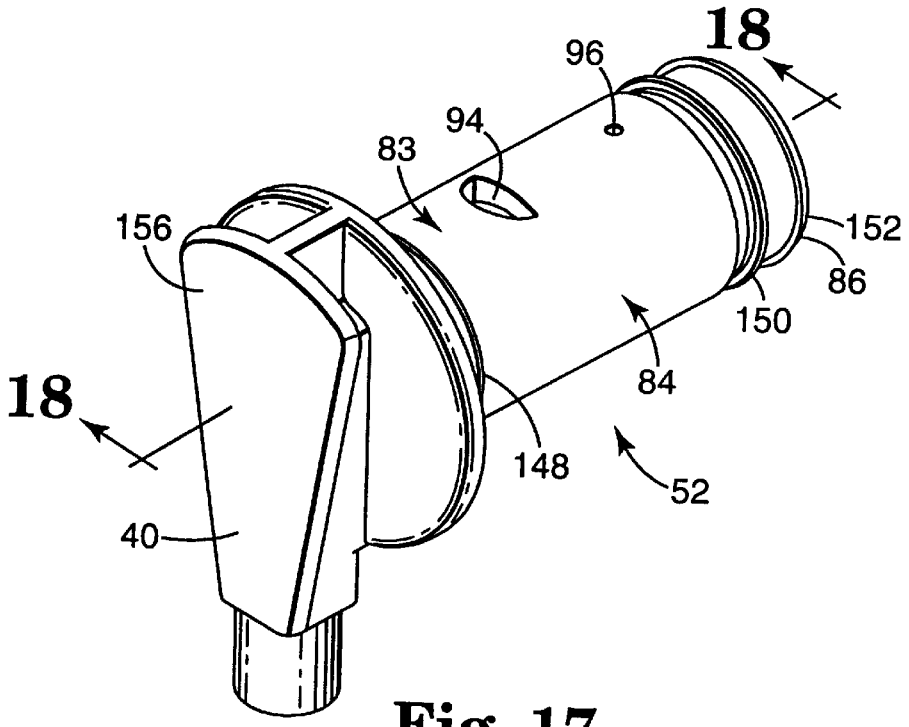
FIG. 17 is a perspective view of a spool element for use in the container assembly.
Figure 18:
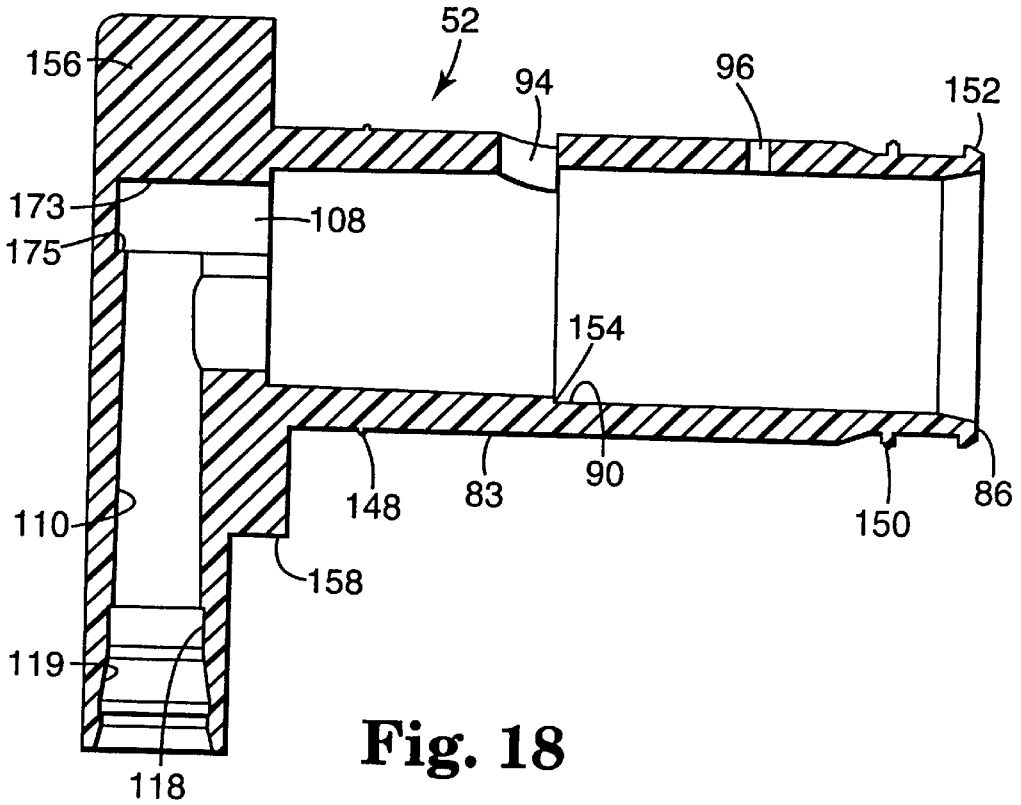
FIG. 18 is a cross-section view of the spool element of FIG. 17 taken substantially along section lines 18—18 in FIG. 17.

At first end 86, the spool element 52 is adapted to connect to a retaining element 88. Referring now to FIGS. 17 and 18, the second end of the spool element 52 is shaped as a knob 40 that integrally includes outlet tube 110. The spool 52 includes two externally projecting ribs 148 and 150 that seal with the passageway 46 in the cover 38 by means of an interference fit. The first end 86 of the spool element 52 is adapted to be axially retained in the cover 38 by any convenient means. In the depicted embodiment, the first end 86 of the spool element 52 includes an externally projecting lip 152 that engages a snap fit joint on retaining element 88, but other expedients such as a threaded retainer or a split ring retainer could be used.

The pump chamber 90 is open at first end 86 and is in part defined by the inner surfaces of the knob 40 at the other end. The pump chamber 90 contains the piston 98 and the piston return spring 100. A shoulder 154 in the pump chamber 90 acts as a piston stop. The knob 40 includes a flange 156 adapted for grasping by the hand of a user. The flange 156 of the knob 40 can include projections 158 adapted to limit the rotation of the spool element 52 in the cover 38. Preferably, the valve assembly rotates approximately one-hundred twenty (120) degrees between the sealed and dispense positions.

Figure 20:
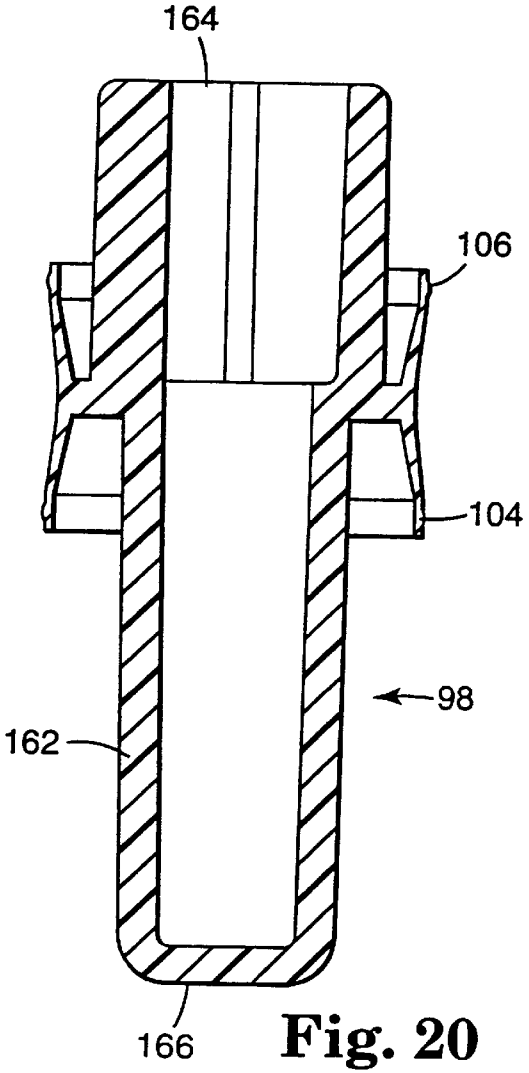
FIG. 20 is a cross-section view of the piston of FIG. 19 taken substantially along section lines 20—20 in FIG. 19.
Figure 19:
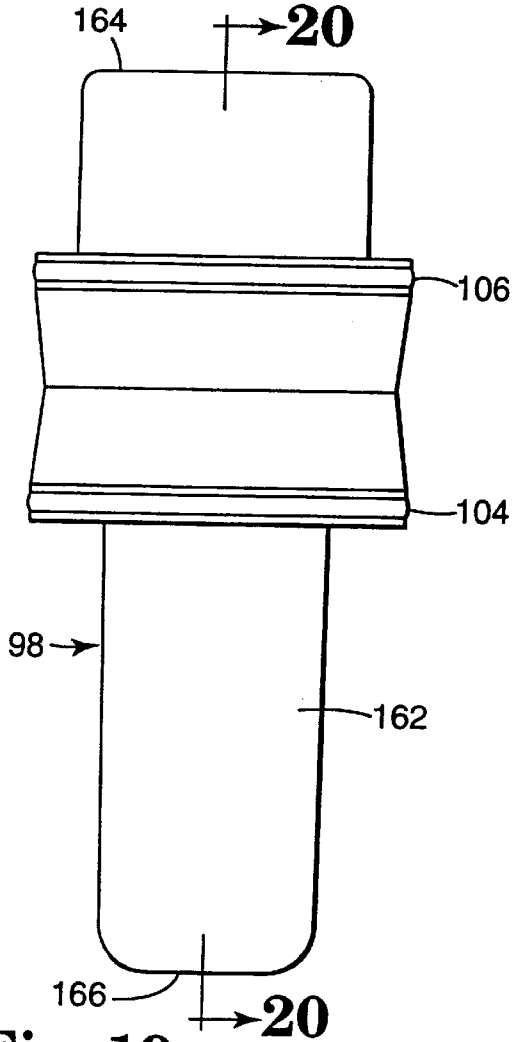
FIG. 19 is a side view of a piston for use in a pump in the container assembly.

Referring now to FIGS. 19 and 20, the piston 98 is seen in isolation. The piston 98 slidably seals in the pump chamber 90 and includes a rod portion 162. The piston 98 preferably includes multiple piston seals 104 and 106 but could optionally include a single sealing surface. The vent hole 96 in the spool element 52 is blocked between the two piston surfaces 104 and 106 in the return position of the piston 98. The two piston surfaces 104 and 106 are supported from the rod portion by any convenient structure. The driven surface 164 transmits the force from an actuator 196 in the bracket/actuator assembly 34 as will be explained with more particularity below. The second end 166 of the rod portion 162 retains the piston return spring 100. The piston 98 can be fabricated from any material compatible with the liquid to be dispensed; in the presently preferred embodiment, the piston 98 is injection molded from a thermoplastic material, such as, but not limited to high density polyethylene (HDPE).

Figure 22:
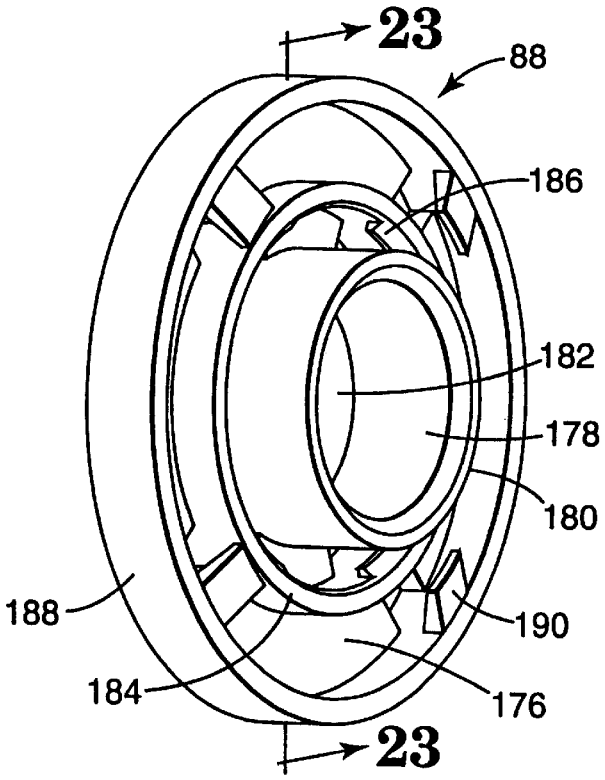
FIG. 22 is a perspective view of a retaining element for use in the container assembly.
Figure 23:
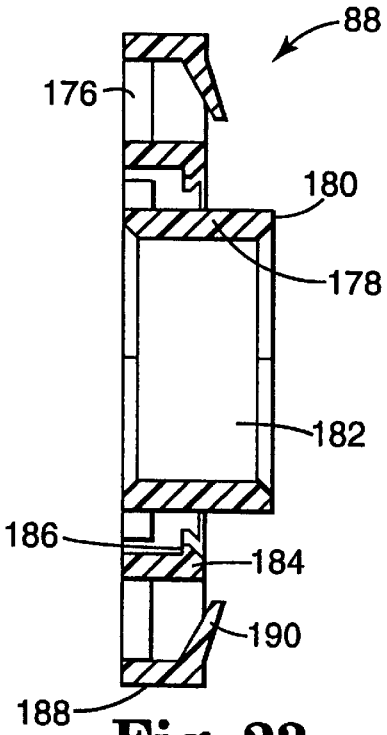
FIG. 23 is a cross-section view of the retaining element of FIG. 22 taken along section lines 23—23 in FIG. 22.

Referring now to FIGS. 5, 22 and 23, the retaining element 88 connects to the spool element 52 to axially hold the spool element 52 in the cover 38 and to retain the piston 98 in the spool element 52 in the normal spring-biased (return) position. A number of expedients for retaining the spool element 52 may be used, such as a threaded retainer or a split ring retainer.

The retaining element 88 includes three concentric bosses projecting from a cylindrical disc portion 176. The first central boss 178 fits inside the spool element 52. The top surface 180 of the first boss 178 retains the piston 98 in the return position. An axial bore 182 in the first boss 178 functions as a bushing for the piston 98 and the reciprocating actuator 196 of the bracket/actuator assembly 34. The second middle boss 184 includes projections 186 that connect to the first end 86 of the spool element 52 by means of a snap fit. The third outer boss 188 includes multiple, inwardly projecting, cantilevered beams 190 that axially bias the spool element 52 against the cover 38. In the presently preferred embodiment, the retaining element 88 is injection molded from a thermoplastic material, such as high density polyethylene.

Figure 24:
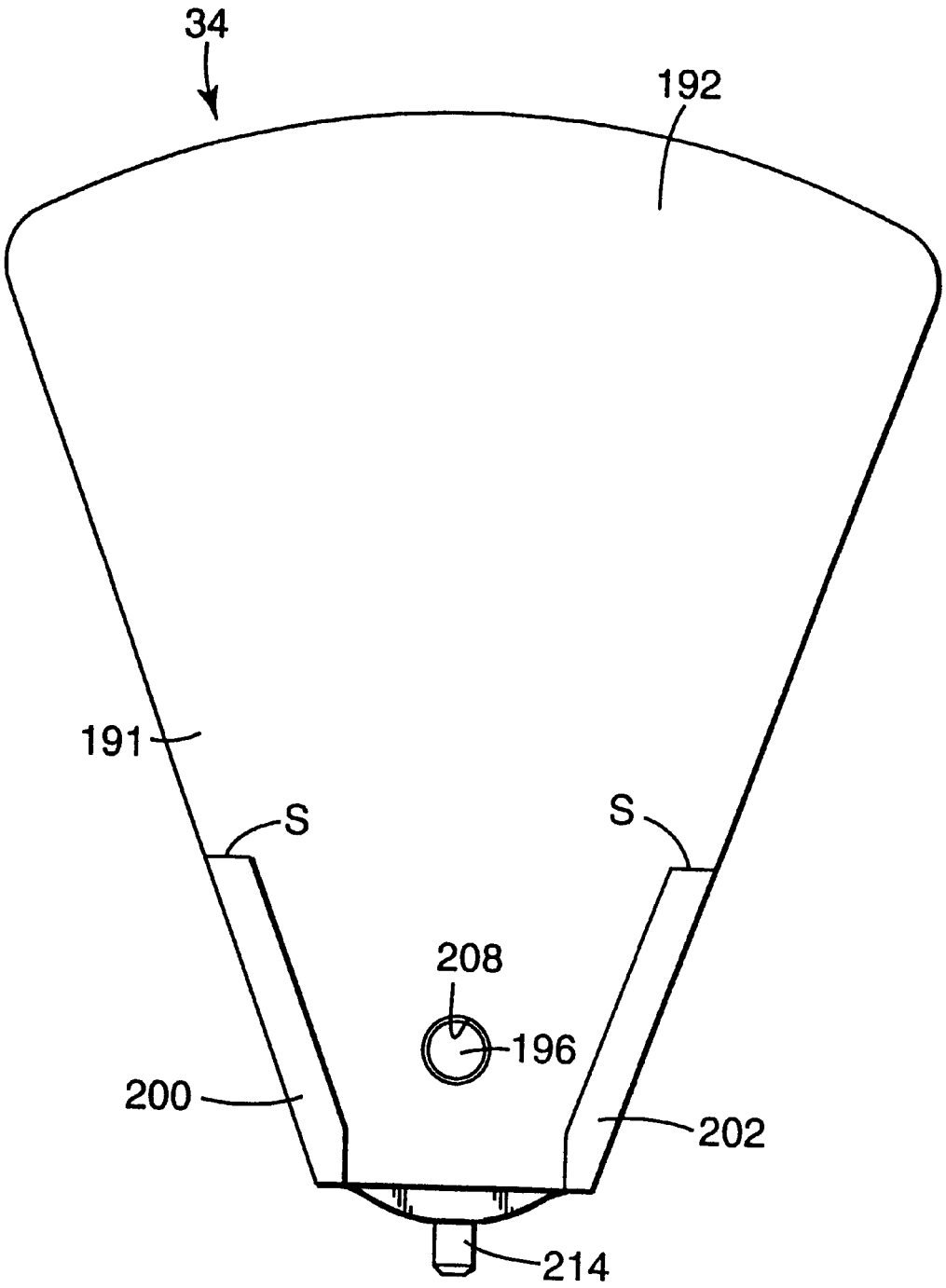
FIG. 24 is a front view of the bracket/actuator assembly of FIG. 1 with the container assembly and foot actuated pneumatic bladder pump omitted.

Referring now to FIGS. 24 and 25, the bracket/actuator assembly 34 includes a housing 191 including a front housing 192 and a rear housing 194. Mounted within the two housings are the actuator 196 and a means 198 to drive the actuator 196. The front and rear housings 192 and 194 can be fabricated in any convenient shape, although it is desirable to provide an exterior surface with simple planar projections as depicted so as to make the bracket/actuator assembly 34 easy to clean. Preferably, the bracket/actuator assembly 34 is formed from a plastic material in a shape visually similar to the disposable container assembly 32.

The front housing 192 includes a passageway 208 that serves as a bushing for the actuator 196. The means 198 for moving the actuator 196 conveniently includes a cavity 210 in the rear housing 194 in which the actuator can slide forwards and back. An air chamber 212 disposed behind the cavity 210 is in fluid communication with the hose 221 which allows the air chamber to be pressurized. When the air chamber is pressurized, the actuator 196 is moved forward and against the driven surface 164 of the piston 98. The piston return spring 100 in the container assembly 32 helps return the actuator when the air chamber 212 is depressurized. An actuator seal 216 is provided to prevent leakage of air from the air cavity past the actuator 196. The seal 216 can include any well known devices such as o-rings, v-rings, u-seals, diaphragms, and rolling diaphragms.

While the depicted embodiment shows the actuator 196 being moved pneumatically, the actuator can be reciprocated by any of several well known means including mechanically, for example a mechanical linkage to a user operated lever; electromechanically, for example a motor and a lead screw; or hydraulically, for example a fluid actuator.

The various parts of the container assembly 32 may be injection molded from a thermoplastic material. The spool element 52 can be fabricated from any material compatible with the liquid to be dispensed. In a preferred embodiment, the spool element 52 is injection molded from a thermoplastic material, such as, but not limited to high density polyethylene. The flexible, resilient member 112 can be fabricated from any elastomeric material compatible with the product to be dispensed. In a preferred embodiment, the flexible, resilient member 112 is molded from a compatible elastomer by well known processes; conveniently, the member 112 is injection molded from a thermoplastic elastomer. As an example not intended to be limiting, the member 112 may be constructed from a thermoplastic elastomer, such as, but not limited to Santoprene 271-64 available from Advanced Elastomer Systems.

OPERATION

Set up of the dispenser 30 may begin with attaching the bracket/actuator assembly 34 in a convenient location, such as on the wall by a sink or on a wheel mounted vertical pole (not shown). The foot actuated pneumatic bladder pump 220 is coupled to the bracket/actuator assembly 34 with the air hose 221 through port 214.

The container assembly 32 may then be attached to the bracket/actuator assembly 34 in the manner shown in FIG. 3, except that typically the valve assembly will be in the sealed position (as opposed to the dispense position shown in FIG. 3) during attachment of the container assembly 32 to the bracket/actuator assembly 34. The rear wall 39 of the container assembly 32 is placed opposite the front housing 192 of the bracket/actuator assembly 34 and the container assembly is moved in a substantially vertically downward direction 10 until the flanges 200 and 202 engage the channels 138 and 140. The flanges 200 and 202 and channels 138 and 140 are situated to automatically guide the driven surfaces 164 of the piston 98 to a position opposite the actuator 196. Engagement between the stop surfaces S and the shoulder surfaces 143 and 145 limits the insertion of the container assembly 32 into the bracket/actuator assembly 34 at the point where the piston 98 is properly oriented relative to the actuator 196.

Once the container assembly 32 is attached to the bracket assembly, the valve assembly should be moved from the sealed position (FIG. 2) to the dispense position (FIG. 1). Preferably, in the dispense position, the outlet 42 opens substantially vertically downward.

To dispense the product from the dispenser 30, the user now steps on the foot actuated pneumatic bladder 220 which causes the actuator 196 to move from the retracted (FIG. 25 solid lines) position to the extended position (FIG. 25 dashed lines). Movement of the actuator from the retracted to the extended position causes the distal end of the actuator 196 to engage the driven surfaces 164 of the piston 98 and drives the piston from the return position to the actuated position.

FIGS. 26 through 30 sequentially illustrate movement of the piston 98 from the return to actuated position and back to the return position. The actuator 198 is omitted from these views to emphasize other details.

In FIG. 26, the piston 98 is biased to the return position by spring 100. The vent tube 82 and hole 96 are sealed from atmospheric air by piston seal surface 106. After the pump is primed, the pump chamber 90 is full of a precise, metered amount of product to be dispensed, regardless of the amount of product in the reservoir. The pump chamber 90 is sealed by the piston seal surfaces 104 and 106 and the flexible, resilient member 112 in the relaxed position. Because the ball 146 of the ball valve is in a down, closed position, product from the pump chamber 90 cannot travel from the pump chamber 90 back into the reservoir via first passageway 76.

The arrow in FIG. 27 illustrates the direction of movement of the piston 98. The piston 98 is shown just as it moves from the return toward the actuated position. As the piston 98 moves, pressure within the pump chamber 90 increases and causes the flexible, resilient member 112 to be initially displaced from its relaxed position in FIG. 26 to a displaced, sealing position (FIG. 27). While the flexible resilient member 112 still seals the pump chamber 90 when it is in the displaced, sealing position, it seals with a different portion of the inner surface 118 than it does when it is in the relaxed position. At this point, the dispenser has not yet dispensed product.

FIG. 28 illustrates the piston 98 after it has moved further along its stroke toward the actuated position. After sufficient pressure builds up in the pump chamber 90, the flexible, resilient member 112 stretches axially to a deflected, dispense position which affords dispensing of the product from pump chamber 90 through the outlet 42. The axial stretching of the member 112 opens an annular path for the product to flow from the pump chamber 90, past the sealing portion 174 of the member 112 and past the inner surface 119 which is just adjacent the sealing portion 174 when the member 112 is in the deflected, dispense position.

FIG. 29 illustrates the piston 98 in the actuated position. Once the pressure within the pump chamber 90 dissipates sufficiently, the internal resilience of the flexible, resilient member 112 causes the member 112 to retract from the deflected, dispense position (FIG. 28) back to the displaced sealing position (FIG. 29). In this position, the piston seal 106 no longer seals vent hole 96 and vent tube 82 from ambient, and air is allowed to flow from ambient, through vent tube 82 and into the reservoir. Note the arrows in FIG. 29 which show the ingress of air into the reservoir.

FIG. 30 illustrates the piston 98 as it is being spring biased from the actuated position back to the return position. As the piston 98 moves back to the return position, a partial vacuum is created in the pump chamber. Vacuum in the pump chamber 90 causes the flexible, resilient member 112 to move from the displaced sealing position (FIG. 29) back to the relaxed position (FIG. 30). The movement of the member 112 from the displaced sealing position (FIG. 29) back to the relaxed position (FIG. 30) changes the unsealed volume within tube 110 that is substantially adjacent the outlet 42. The unsealed volume adjacent outlet 42 is increased which tends to draw product from the outlet 42 back within outlet tube 110 which helps reduce the chance that the outlet 42 will drip at an inopportune time. Preferably, the outlet 42 is formed by insert 41 which provides a restriction substantially adjacent the outlet 41 to enhance the effectiveness of the flexible, resilient member 112 at preventing drips.

The vacuum also causes the ball 146 of the ball valve to move upward to an open position which affords flow of product from the reservoir, through first passageway 76 and into the pump chamber 90. Note the arrows in FIG. 30 which illustrate the flow of product from the reservoir and into the pump chamber 90. The direction of the piston 98 is also illustrated in FIG. 30 with an arrow. Piston seal 106 has already sealed vent hole 96 and vent tube 82. Once the spring 100 moves the piston to the return position, the elements of the container assembly 32 are back to their position shown in FIG. 26 and the dispenser 30 is ready to be actuated again until product within the reservoir is depleted.

When the product within the reservoir is depleted, the entire container assembly 32 may be disposed of which reduces the chance of contaminant build up within the dispenser 30. A refill container assembly may be attached to bracket/actuated assembly 34 and the process repeated. Optionally, but not preferably, product with the reservoir may be simply be replenished (or a new, full bottle 36 may be supplied for the container assembly 32) and the other elements of the container assembly (e.g. the pump and valve assembly) may be reused.

The present invention has now been described with reference to several embodiments thereof It will be apparent to those skilled in the art that many changes or additions can be made in the embodiments described without departing from the scope of the present invention.

What is claimed is:

1. A container assembly attachable to a bracket/actuator assembly having a movable actuator and a pair of mounting flanges; said container assembly comprising:

a reservoir for holding product to be dispensed, an outlet sized and shaped to afford passage of product to be dispensed;

a pump, operatively associated with the actuator, for pumping the product through the outlet, the pump including a driven surface for receiving the actuator;

a pair of channels which are sized and shaped to cooperatively receive the mounting flanges of the bracket/actuator assembly to attach the container assembly to the bracket/actuator assembly and to align the driven surface of the pump with the actuator when the container assembly is attached to the bracket/actuator assembly;

wherein the container assembly is attachable to the bracket/actuator assembly in a vertically downward direction; and the channels are elongate and situated so that they taper toward each other in the direction of attachment so that the driven surface of the pump is guided into a predetermined orientation relative to the actuator substantially simultaneously with attachment of the container assembly to the bracket/actuator assembly in the vertically downward direction.

2. A container assembly according to claim 1 wherein the container assembly includes a substantially planar rear wall adapted to abut the bracket/actuator assembly when the container assembly is attached to the bracket/actuator assembly.

3. A container assembly according to claim 1 wherein the container assembly includes top, front, and side walls with surfaces which are substantially free of sudden discontinuities to afford ease of cleaning.

4. A container assembly according to claim 1 wherein the container assembly includes a valve assembly that includes said outlet, and wherein said valve assembly is movable relative to the reservoir between a first position which seals the product within said reservoir and a second position which affords dispensing of product through the outlet.

5. A container assembly according to claim 4 wherein said valve assembly is adapted to rotate between said first and second positions.

6. A container assembly according to claim 4 wherein said reservoir has a vertical axis, said valve assembly is elongate along an axis which is perpendicular to the vertical axis of the reservoir.

7. A container assembly according to claim 6 wherein said valve assembly is adapted to rotate approximately one hundred twenty degrees between said first and second positions; and wherein, in said second position, said outlet opens downwardly.

8. A container assembly according to claim 1 wherein the container assembly is disposable and includes a product path between the reservoir and the outlet, and said product path is located entirely within said container assembly so that the entire product path is disposed of upon disposal of the container assembly.

9. A container assembly according to claim 1 wherein said container assembly includes a pair of side walls which taper toward each other in the direction of attachment, and said side walls each include one of said channels.

10. A container assembly according to claim 9 wherein said side walls have bottom, rear portions and said channels are located in the bottom, rear portions of said side walls.

11. A container assembly according to claim 9 wherein the container assembly includes a bottom wall, and said channels have a first end opening onto the bottom wall and a second end defined by a shoulder surface which is adapted to engage a stop surface of the bracket/actuator assembly.

12. A method of using a disposable container assembly which is attachable to a bracket/actuator assembly having a movable actuator and a pair of mounting flanges; the method comprising the steps of:

a) providing a container assembly including: a reservoir for holding product to be dispensed, an outlet sized and shaped to afford passage of product to be dispensed;

a pump, operatively associated with the actuator, for pumping the product through the outlet, the pump including a driven surface for receiving the actuator; a pair of channels which taper toward each other and which are sized and shaped to cooperatively receive the mounting flanges of the bracket/actuator assembly; and b) attaching the container assembly to the bracket/actuator assembly and substantially simultaneously aligning the driven surface of the pump with the actuator by moving the container assembly in a substantially vertically downward direction relative to the bracket/actuator assembly until the channels engage the mounting flanges.

13. A method of using a disposable container assembly according to claim 12 wherein the step of providing a container assembly includes the step of providing a valve assembly that includes said outlet, and the valve assembly is adapted to move relative to the reservoir between a first position which seals the product within said reservoir and a second position which affords dispensing of product through the outlet; and the method further comprises the step of moving the valve assembly from said first position to said second position.

14. A method of using a disposable container assembly according to claim 13 wherein the step of moving the valve assembly includes the step of rotating the valve assembly from said first to said second position.

15. A method of using a disposable container assembly according to claim 14 wherein the step of rotating the valve assembly includes the step of rotating the valve assembly approximately one hundred and twenty degrees between said first and second positions, such that, in the second position, the outlet opens downwardly.

16. A method of using a disposable container assembly according to claim 12 wherein the step of providing a container assembly comprises the step of providing a disposable container assembly with a product path between the reservoir and the outlet which is located entirely within the container assembly; and the method further includes the step of disposing of the entire product path upon depletion of the container assembly.

17. A dispenser for product comprising:

a bracket/actuator assembly having a movable actuator and a pair of mounting flanges;

a container assembly comprising:

a reservoir for holding the product to be dispensed, an outlet sized and shaped to afford passage of product to be dispensed;

a pump, operatively associated with the actuator, for pumping the product through the outlet, the pump including a driven surface for receiving the actuator;

attachment and alignment means for attaching the container assembly to the bracket/actuator assembly and for automatically aligning the driven surface of the pump with the actuator during attachment of the container assembly to the bracket/actuator assembly; wherein said attachment and alignment means comprises a pair of inwardly directed flanges on one of said bracket/actuator and container assemblies and surfaces for engaging said flanges on the other of said assemblies; and wherein the attachment and alignment means affords attachment of said container assembly to the bracket/actuator assembly, and alignment of the driven surface of the pump with the actuator, in a vertically downward direction.

18. A dispenser according to claim 17 wherein the dispenser includes top, front, and side walls with surfaces which are substantially free of sudden discontinuities to afford ease of cleaning.

19. A dispenser according to claim 17 wherein the container assembly is disposable and includes a product path between the reservoir and the outlet, and said product path is located entirely within said container assembly so that the entire product path is disposed of upon disposal of the container assembly.

20. A dispenser according to claim 17 wherein said container assembly includes a pair of side walls which taper toward each other in the direction of attachment, and said side walls each include one of said surfaces for engaging said flanges.

21. A dispenser according to claim 20 wherein the flanges of the bracket/actuator assembly include a stop surface;

the container assembly has a bottom wall, and the surfaces for engaging said flanges have a first end opening onto the bottom wall and a second end defined by a shoulder surface which is adapted to engage said stop surfaces of the bracket/actuator assembly when the container assembly is attached to the bracket/actuator assembly.

22. A disposable container assembly attachable to a bracket/actuator assembly having an actuator movable between a retracted position which affords attachment of the disposable container assembly to the bracket/actuator assembly and an extended position spaced from the retracted position; said disposable container assembly comprising:

a substantially closed reservoir for holding product to be dispensed, a pump for pumping the product, the pump including a driven surface for receiving the actuator and being driven by the actuator when the actuator moves from the retracted to the extended position;

a valve assembly having inner surfaces adapted to receive the pump and to define a pump chamber, outer surfaces including sealing surfaces for sealing the reservoir, the outer surfaces of the valve assembly also including grasping surfaces that are sized and shaped to be manually grasped, an outlet sized and shaped to afford passage of product to be dispensed; and surfaces extending between said inner and outer surfaces to define a fill hole;

the disposable container assembly including a product path that is located entirely within the container assembly so that the entire product path is disposed of upon disposal of the container assembly; and wherein the grasping surfaces are located on external surfaces of the disposable container assembly so that the valve assembly is manually movable between a sealed position with the sealing surfaces sealing the pump chamber from the reservoir, and a dispense position with the fill hole affording passage of the product from the reservoir to the pump chamber.

23. A container assembly according to claim 22 wherein said grasping surfaces are rotatable from said sealed toward said dispense positions.

24. A container assembly according to claim 23 wherein said product reservoir is constructed to be suitable for holding sterilizing or disinfecting or antimicrobial product.

25. A container assembly according to claim 22 wherein said grasping surfaces comprise a knob having an outlet tube therein, said outlet tube having said outlet.

26. A container assembly attachable to a bracket/actuator assembly having an actuator movable between a retracted position which affords attachment of the container assembly to the bracket/actuator assembly and an extended position spaced from the retracted position; said container assembly comprising:

a reservoir for holding product to be dispensed, a pump for pumping the product, the pump including a driven surface for receiving the actuator and being driven by the actuator when the actuator moves from the retracted to the extended position;

a valve assembly having inner surfaces adapted to receive the pump and to define a pump chamber, outer surfaces including sealing surfaces for sealing the reservoir, grasping surfaces that are sized and shaped to be manually grasped, an outlet sized and shaped to afford passage of product to be dispensed; and surfaces extending between said inner and outer surfaces to define a fill hole;

a cover adapted to receive the reservoir, and having surfaces defining a passageway;

said valve assembly comprises a spool element adapted to be received in the passageway of the cover;

wherein the valve assembly is movable between a sealed position with the sealing surfaces sealing the pump chamber from the reservoir, and a dispense position with the fill hole affording passage of the product from the reservoir to the pump chamber, and the spool element rotates between said sealed and dispense positions.

27. A container assembly according to claim 26 wherein said spool element includes a vent hole affording passage of replacement air into the reservoir;

said reservoir includes a plug having first and second passageways; said first passageway affording passage of product from said reservoir to said pump chamber, and said second passageway affording passage of replacement air into the reservoir; and wherein, in the sealed position, said sealing surfaces seal said first and second passageways, and in said dispense position, said fill hole is aligned with said first passageway and said vent hole is aligned with said second passageway.

28. A container assembly according to claim 27 wherein said first passageway includes a one-way valve for preventing flow of product from said pump chamber to said reservoir.

29. A container assembly according to claim 27 wherein the one-way valve comprises a ball valve having a ball, said ball being movable between an open position which affords passage of product from the reservoir to said pump chamber, and a closed position which prevents flow of product from the pump chamber to said reservoir; and wherein, gravity biases said ball toward said closed position.

30. A container according to claim 27 wherein said pump means comprises a piston mounted within the inner surfaces of said valve assembly for movement between a return position and an actuated position, said driven surface comprises driven surfaces on said piston which are sized and shaped to receive the actuator;

wherein movement of said actuator from said retracted to said extended position causes said actuator to engage the driven surfaces of said piston and drive said piston from said return position to said actuated position; and said piston includes first and second piston seals situated to seal said vent hole when said piston is in said return position, and to afford passage of ambient through said vent hole, said second passageway and into the reservoir when said piston is in said actuated position.

31. A method of using a container assembly that is attachable to a bracket/actuator assembly having an actuator movable between a retracted position which affords attachment of the container assembly to the bracket/actuator assembly and an extended position spaced from the retracted position; the method comprising the steps of:

a) providing the container assembly including a reservoir for holding product to be dispensed, a pump for pumping the product, the pump including a driven surface for receiving the actuator and being driven by the actuator when the actuator moves from the retracted to the extended position; a valve assembly having inner surfaces adapted to receive the pump and to define a pump chamber, outer surfaces including sealing surfaces for sealing the reservoir, grasping surfaces that are sized and shaped to be manually grasped, an outlet sized and shaped to afford passage of product to be dispensed; and surfaces extending between said inner and outer surfaces to define a fill hole;

b) mounting the valve assembly for movement between a sealed position that avoids unintended dispensing of product, and a dispense position that is spaced from the sealed position so that product may be dispensed;

c) placing product to be dispensed within the reservoir, d) storing the valve assembly in the sealed position, and e) moving the valve assembly from the sealed position to the dispense position prior to dispensing product.

32. A method according to claim 31 wherein the step of moving the valve assembly from the sealed position to the dispense position includes the step of rotating the valve assembly from the sealed position to the dispense position.

* * * * *